US011076215B2

(12) United States Patent
Kim et al.

(10) Patent No.: US 11,076,215 B2
(45) Date of Patent: Jul. 27, 2021

(54) ELECTRONIC DEVICE INCLUDING SPEAKER AND MICROPHONE

(71) Applicant: Samsung Electronics Co., Ltd., Gyeonggi-do (KR)

(72) Inventors: Seonmi Kim, Gyeonggi-do (KR); Hangil Moon, Gyeonggi-do (KR); Jeock Lee, Gyeonggi-do (KR); Hwan Shim, Gyeonggi-do (KR); Hansol Kim, Gyeonggi-do (KR); Haekeu Park, Gyeonggi-do (KR); Juhee Chang, Gyeonggi-do (KR); Hyeonyeong Jeong, Gyeonggi-do (KR); Sunghoon Cho, Gyeonggi-do (KR); Hochul Hwang, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/705,482

(22) Filed: Dec. 6, 2019

(65) Prior Publication Data

US 2020/0186907 A1 Jun. 11, 2020

(30) Foreign Application Priority Data

Dec. 7, 2018 (KR) ..... 10-2018-0156940

(51) Int. Cl.
*H04R 1/04* (2006.01)
*H04R 1/10* (2006.01)
*H04R 3/04* (2006.01)

(52) U.S. Cl.
CPC ..... *H04R 1/1016* (2013.01); *H04R 1/04* (2013.01); *H04R 3/04* (2013.01)

(58) Field of Classification Search
CPC .. G10K 11/17854; H04R 1/04; H04R 1/1016; H04R 3/04; H04R 1/08; H04R 1/1083;
(Continued)

(56) References Cited

U.S. PATENT DOCUMENTS 5,692,059 A * 11/1997 Kruger ..... H04R 1/1016 381/151
7,004,582 B2 * 2/2006 Jannard ..... G02C 11/06 351/158

(Continued)

FOREIGN PATENT DOCUMENTS

JP 2007-201887 A 8/2007
JP 2010-288156 A 12/2010

(Continued)

OTHER PUBLICATIONS

International Search Report dated Mar. 20, 2020.

*Primary Examiner* — Gerald Gauthier
(74) *Attorney, Agent, or Firm* — Cha & Reiter, LLC

(57) ABSTRACT

Certain embodiments of the disclosure relate to microphone-equipped wearable devices, and more particularly, to wearable devices worn on users' ear. According to certain embodiments of the disclosure, a wearable device comprises a speaker, a microphone, and a housing, the housing includes a protrusion configured to be insertable into a user's ear, a first sound path including a first opening formed through an area of a surface of the protrusion, extending from the first opening in a first length, and including a second opening facing the speaker, and a second sound path including a third opening formed through another area of the surface of the protrusion, extending from the third opening in a second length larger than the first length, and including a fourth opening facing the microphone. Other certain embodiments are also possible.

22 Claims, 14 Drawing Sheets

(58) Field of Classification Search
CPC .... H04R 1/2846; H04R 29/001; H04R 3/005; G10L 17/04
USPC ..... 381/66, 72, 74, 150, 151, 317, 56, 338; 455/569.1; 600/474
See application file for complete search history.

(56) References Cited

U.S. PATENT DOCUMENTS 8,111,854 B2 * 2/2012 Peng ..... H04R 1/1075 381/338
8,548,532 B1 * 10/2013 Ng ..... H04M 1/2757 455/569.1
9,414,155 B2 * 8/2016 Mulumudi ..... A61B 7/04
9,473,846 B2 * 10/2016 Parkins ..... A61F 11/14
9,762,989 B2 9/2017 Shin
9,955,248 B2 * 4/2018 Baek ..... H04B 1/385
10,896,682 B1 * 1/2021 Dusan ..... H04R 1/083
2009/0185045 A1 * 7/2009 Rosenblatt ..... H04N 5/2254 348/222.1
2010/0316225 A1 * 12/2010 Saito ..... H04R 1/1083 381/56
2011/0129107 A1 * 6/2011 Andersen ..... H04R 1/083 381/317
2013/0094658 A1 * 4/2013 Holter ..... A61F 11/08 381/72
2013/0130749 A1 * 5/2013 Andersen ..... H04M 1/05 455/569.1
2013/0142351 A1 * 6/2013 Andersen ..... H04R 25/55 381/74
2013/0218022 A1 * 8/2013 Larsen ..... A61B 5/01 600/474
2013/0336512 A1 12/2013 Kim
2014/0044286 A1 * 2/2014 Coles ..... H04R 1/028 381/150
2014/0233746 A1 * 8/2014 Tanaka ..... H04R 1/1058 381/66
2016/0165334 A1 6/2016 Grossman
2016/0302000 A1 10/2016 Shin
2017/0006380 A1 * 1/2017 Gobeli ..... H04R 3/04
2017/0318401 A1 11/2017 Chang et al.
2018/0020281 A1 * 1/2018 Wurtz ..... G10K 11/17881
2018/0096674 A1 4/2018 Lin et al.
2020/0186907 A1 * 6/2020 Kim ..... H04R 3/04
2020/0193955 A1 * 6/2020 Hsu ..... H04R 1/1083
2020/0252708 A1 * 8/2020 Zhu ..... H04R 1/1075
2020/0404441 A1 * 12/2020 Copt. ..... H04S 7/302

FOREIGN PATENT DOCUMENTS

JP 2016-116153 A 6/2016
KR 10-2016-0029637 A 3/2016
KR 10-1693268 B1 1/2017
KR 10-1762671 B1 8/2017
WO 2016/103779 A1 6/2016

* cited by examiner

WHEN MICROPHONE PATH IS SHORT

WHEN MICROPHONE PATH IS LONG

ELECTRONIC DEVICE INCLUDING SPEAKER AND MICROPHONE

CROSS-REFERENCE TO RELATED APPLICATION(S)

This application is based on and claims priority under 35 U.S.C. 119 to Korean Patent Application No. 10-2018-0156940, filed on Dec. 7, 2018, in the Korean Intellectual Property Office, the disclosure of which is herein incorporated by reference in its entirety.

BACKGROUND

Field

Certain embodiments of the disclosure relate to electronic devices including a speaker and a microphone.

Description of Related Art

An electronic device may come with at least one or more sound effect-related components. Sound effect-related components may include, e.g., a speaker and a microphone. Such components may sit in the housing of the electronic device in various patterns or arrangements corresponding to various exterior designs of the electronic device.

Microphone-integrated in-ear earphones (or earsets, headphones, or headsets), hearing aids, or such wearable devices are example electronic devices which are equipped with a speaker and a microphone, as sound-related components of a wearable device. Wearable devices may be worn close to the users' ear and may be manufactured in compact size.

The above information is presented as background information only to assist with an understanding of the disclosure. No determination has been made, and no assertion is made, as to whether any of the above might be applicable as prior art with regard to the disclosure.

SUMMARY

In accordance with certain embodiments of the disclosure, a wearable device comprises a speaker, a microphone, and a housing, wherein the housing includes a protrusion configured to be insertable into a user's ear, a first sound path including a first opening formed through an area of a surface of the protrusion, extending from the first opening in a first length, and including a second opening facing the speaker, and a second sound path including a third opening formed through another area of the surface of the protrusion, extending from the third opening in a second length larger than the first length, and including a fourth opening facing the microphone.

In accordance with certain embodiments of the disclosure, a wearable device comprises a speaker, a microphone, and a housing, wherein the housing includes a protrusion configured to be insertable into a user's ear, a first sound path including a first opening formed through an area of a surface of the protrusion, extending from the first opening in a first length, and including a second opening facing the speaker, and a second sound path including a third opening formed through another area of the surface of the protrusion, extending from the third opening in a second length, and including a fourth opening facing the microphone, wherein the microphone and the speaker are arranged in an internal space of the housing, and wherein the microphone is spaced further away from the surface of the protrusion than the speaker is.

In accordance with various embodiments of the disclosure, an electronic device comprises a speaker, a microphone, and a housing, wherein the housing includes a protrusion configured to be insertable into a user's ear, a first sound path including a first opening formed through an area of a surface of the protrusion, extending from the first opening in a first length, and including a second opening facing the speaker, a second sound path including a third opening formed through another area of the surface of the protrusion, extending from the third opening in a second length, and including a fourth opening facing the microphone, and a processor configured to process a sound signal received via the microphone, wherein the microphone and the speaker are arranged in an internal space of the housing, and wherein the microphone is spaced further away from the surface of the protrusion than the speaker is, and wherein the processor is configured to perform a filtering task while processing the sound signal received via the microphone.

Other aspects, advantages, and salient features of the disclosure will become apparent to those skilled in the art from the following detailed description, which, taken in conjunction with the annexed drawings, discloses exemplary embodiments of the disclosure.

BRIEF DESCRIPTION OF THE DRAWINGS

A more complete appreciation of the disclosure and many of the attendant aspects thereof will be readily obtained as the same becomes better understood by reference to the following detailed description when considered in connection with the accompanying drawings, wherein.

Throughout the drawings, like reference numerals will be understood to refer to like parts, components, and structures.

DETAILED DESCRIPTION

Figure 1:
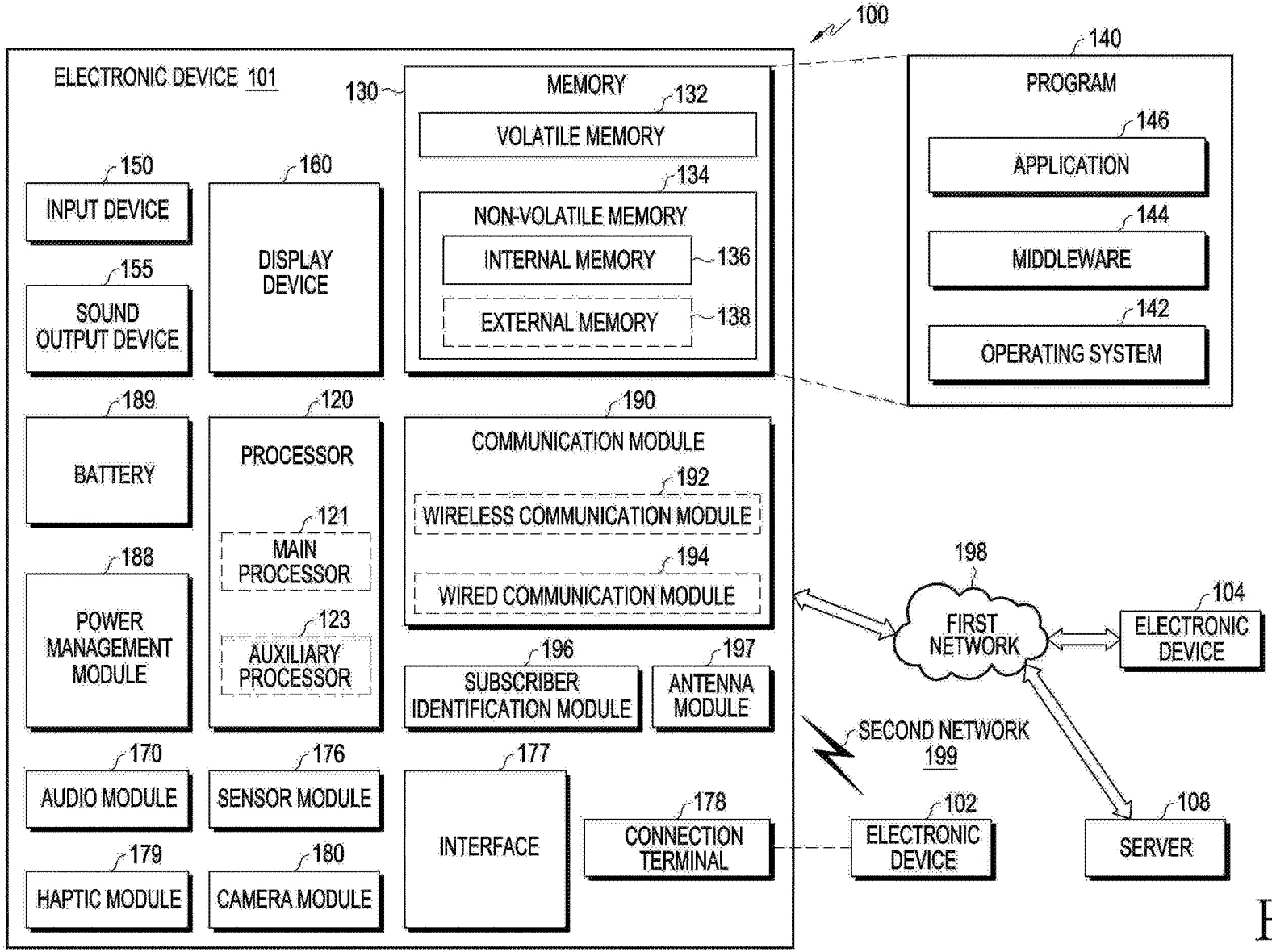
FIG. 1 is a block diagram illustrating an electronic device in a network environment according to an embodiment.

A wearable device may have various sound components and electronic components arranged in a single housing.

The speaker, microphone, or other sound components inside the housing of the wearable device have a direct influence on sound performance, and they are thus required to be arranged carefully. However, simple arrangements have been conventionally adopted, such as an arrangement in which a speaker and a microphone are placed in parallel with each other.

In an example in which a microphone-equipped wearable device is worn on the user's ear for use, sound waves reflected inside the ear may be collected by the microphone. In this case, the conventional wearable device only covers a narrow frequency band (e.g., 2 kHz or less) in which sound energy is not concentrated and thus exhibits poor sound performance.

In far-end speech communications on the microphone-equipped wearable device, the echo signal may be excessively increased, resulting in voice deterioration.

According to certain embodiments of the disclosure, there is provided a wearable device with enhanced sound performance based on the arrangement between sound components, such as the speaker and microphone and the sound characteristics which are varied depending on the paths connected to the speaker and microphone (e.g., sound emission path or sound collection path).

According to certain embodiments of the disclosure, there is provided a wearable device with a mounting structure for the microphone which enables increases mass-producibility and usability.

The following embodiments are provided for one of ordinary skill in the art to easily understand the technical scope of the disclosure and the disclosure is not limited thereto. The accompanying drawings are provided to easily describe the embodiments of the disclosure and may differ from actual implementations.

Before describing in detail several embodiments of the disclosure, it should be noted that applications of the disclosure are not limited to the configuration and arrangements of the components described and shown in connection with the drawings.

When a component is "connected to" or "coupled to" another component, the component may be directly connected or coupled to the other component, or other component(s) may intervene therebetween. The term "connection" may refer to all physical or electrical connections, such as attachment, coupling, joining, or combining, as well as a direct or indirect connection between one member and another.

The terms as used herein are provided merely to describe some embodiments thereof, but not to limit the disclosure. It is to be understood that the singular forms "a," "an," and "the" include plural references unless the context clearly dictates otherwise. It will be further understood that the terms "comprise" and/or "have," when used in this specification, specify the presence of stated features, integers, steps, operations, elements, and/or components, but do not preclude the presence or addition of one or more other features, integers, steps, operations, elements, components, and/or groups thereof.

Hereinafter, embodiments of the disclosure are described with reference to the accompanying drawings. FIG. 1 is a block diagram illustrating an electronic device 101 in a network environment 100 according to certain embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, e.g., software (e.g., a program 140) to control at least one other component (e.g., a hardware or software component) of the electronic device 101 connected with the processor 120 and may process or compute various data. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one (e.g., the display device 160, the sensor module 176, or the communication module 190) of the components of the electronic device 101, instead of the main processor 121 while the main processor 121 is in an inactive (e.g., sleep) state or along with the main processor 121 while the main processor 121 is an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain a sound through the input device 150 or output a sound through the sound output device 155 or an external electronic device (e.g., an electronic device 102 (e.g., a speaker or a headphone) directly or wirelessly connected with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or motion) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 388 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or wireless communication channel between the electronic device 101 and an external electronic device (e.g., the electronic device 102, the electronic device 104, or the server 108) and performing communication through the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module may include one antenna including a radiator formed of a conductor or conductive pattern formed on a substrate (e.g., a printed circuit board (PCB)). According to an embodiment, the antenna module 197 may include a plurality of antennas. In this case, at least one antenna appropriate for a communication scheme used in a communication network, such as the first network 198 or the second network 199, may be selected from the plurality of antennas by, e.g., the communication module 190. The signal or the power may then be transmitted or received between the communication module 190 and the external electronic device via the selected at least one antenna. According to an embodiment, other parts (e.g., radio frequency integrated circuit (RFIC)) than the radiator may be further formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. The first and second external electronic devices 102 and 104 each may be a device of the same or a different type from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
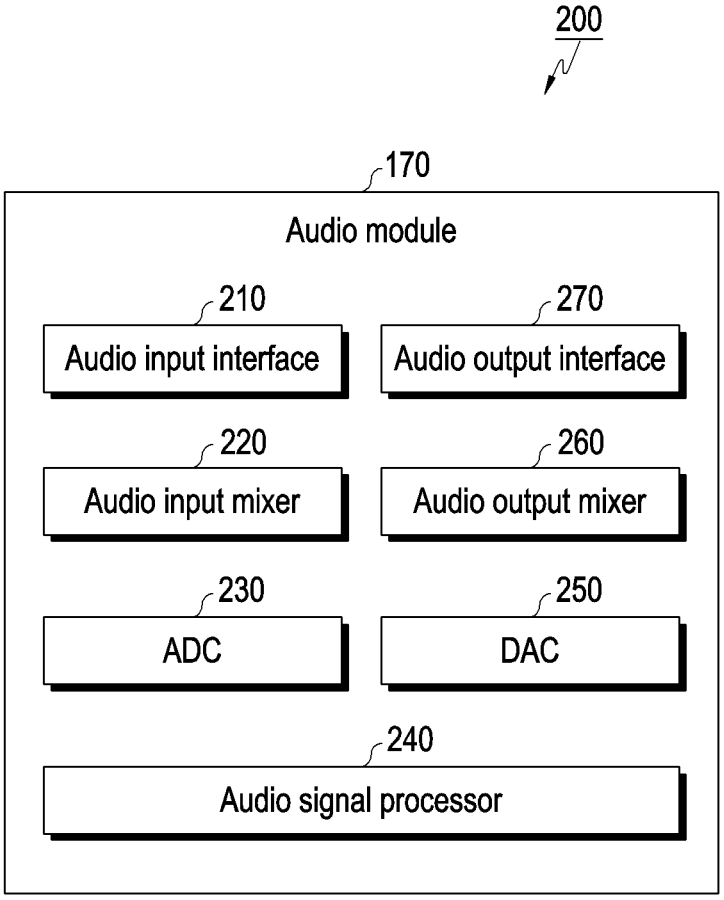
FIG. 2 is a block diagram illustrating an audio module according to an embodiment.

FIG. 2 is a block diagram 200 illustrating the audio module 170 according to certain embodiments. Referring to FIG. 2, the audio module 170 may include, for example, an audio input interface 210, an audio input mixer 220, an analog-to-digital converter (ADC) 230, an audio signal processor 240, a digital-to-analog converter (DAC) 250, an audio output mixer 260, or an audio output interface 270.

The audio input interface 210 may receive an audio signal corresponding to a sound obtained from the outside of the electronic device 101 via a microphone (e.g., a dynamic microphone, a condenser microphone, or a piezo microphone) that is configured as part of the input device 150 or separately from the electronic device 101. For example, if an audio signal is obtained from the external electronic device 102 (e.g., a headset or a microphone), the audio input interface 210 may be connected with the external electronic device 102 directly via the connecting terminal 178, or wirelessly (e.g., Bluetooth™ communication) via the wireless communication module 192 to receive the audio signal. According to an embodiment, the audio input interface 210 may receive a control signal (e.g., a volume adjustment signal received via an input button) related to the audio signal obtained from the external electronic device 102. The audio input interface 210 may include a plurality of audio input channels and may receive a different audio signal via a corresponding one of the plurality of audio input channels, respectively. According to an embodiment, additionally or alternatively, the audio input interface 210 may receive an audio signal from another component (e.g., the processor 120 or the memory 130) of the electronic device 101.

The audio input mixer 220 may synthesize a plurality of inputted audio signals into at least one audio signal. For example, according to an embodiment, the audio input mixer 220 may synthesize a plurality of analog audio signals inputted via the audio input interface 210 into at least one analog audio signal.

The ADC 230 may convert an analog audio signal into a digital audio signal. For example, according to an embodiment, the ADC 230 may convert an analog audio signal received via the audio input interface 210 or, additionally or alternatively, an analog audio signal synthesized via the audio input mixer 220 into a digital audio signal.

The audio signal processor 240 may perform various processing on a digital audio signal received via the ADC 230 or a digital audio signal received from another component of the electronic device 101. For example, according to an embodiment, the audio signal processor 240 may perform changing a sampling rate, applying one or more filters, interpolation processing, amplifying or attenuating a whole or partial frequency bandwidth, noise processing (e.g., attenuating noise or echoes), changing channels (e.g., switching between mono and stereo), mixing, or extracting a specified signal for one or more digital audio signals. According to an embodiment, one or more functions of the audio signal processor 240 may be implemented in the form of an equalizer.

The DAC 250 may convert a digital audio signal into an analog audio signal. For example, according to an embodiment, the DAC 250 may convert a digital audio signal processed by the audio signal processor 240 or a digital audio signal obtained from another component (e.g., the processor (120) or the memory (130)) of the electronic device 101 into an analog audio signal.

The audio output mixer 260 may synthesize a plurality of audio signals, which are to be outputted, into at least one audio signal. For example, according to an embodiment, the audio output mixer 260 may synthesize an analog audio signal converted by the DAC 250 and another analog audio signal (e.g., an analog audio signal received via the audio input interface 210) into at least one analog audio signal.

The audio output interface 270 may output an analog audio signal converted by the DAC 250 or, additionally or alternatively, an analog audio signal synthesized by the audio output mixer 260 to the outside of the electronic device 101 via the sound output device 155. The sound output device 155 may include, for example, a speaker, such as a dynamic driver or a balanced armature driver, or a receiver. According to an embodiment, the sound output device 155 may include a plurality of speakers. In such a case, the audio output interface 270 may output audio signals having a plurality of different channels (e.g., stereo channels or 5.1 channels) via at least some of the plurality of speakers. According to an embodiment, the audio output interface 270 may be connected with the external electronic device 102 (e.g., an external speaker or a headset) directly via the connecting terminal 178 or wirelessly via the wireless communication module 192 to output an audio signal.

According to an embodiment, the audio module 170 may generate, without separately including the audio input mixer 220 or the audio output mixer 260, at least one digital audio signal by synthesizing a plurality of digital audio signals using at least one function of the audio signal processor 240.

According to an embodiment, the audio module 170 may include an audio amplifier (not shown) (e.g., a speaker amplifying circuit) that is capable of amplifying an analog audio signal inputted via the audio input interface 210 or an audio signal that is to be outputted via the audio output interface 270. According to an embodiment, the audio amplifier may be configured as a module separate from the audio module 170.

Figure 3A:
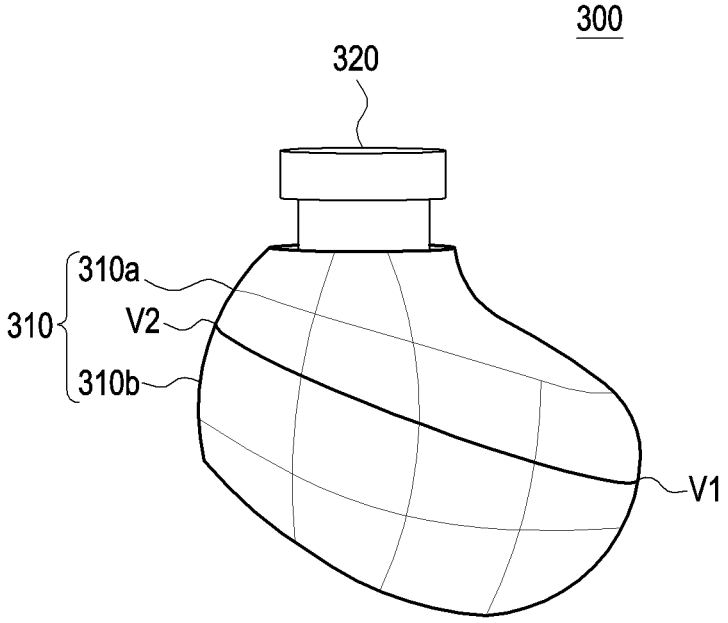
FIGS. 3A, 3B, and 3C are views illustrating the outer appearance of a wearable device according to an embodiment.
Figure 3B:
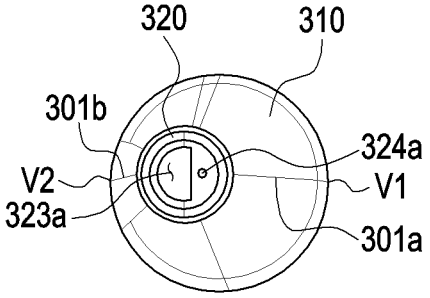
Figure 3C:
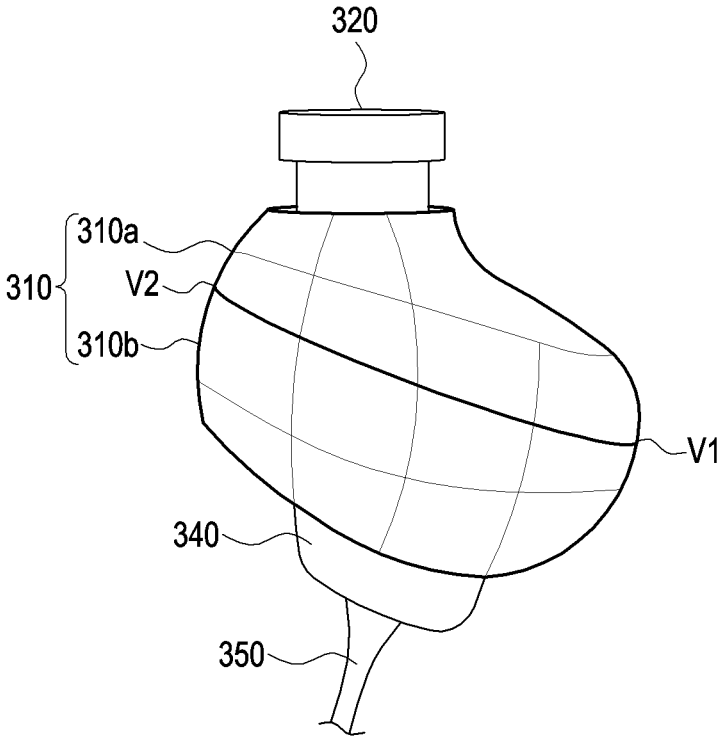

FIGS. 3A, 3B, and 3C are views illustrating the outer appearance of a wearable device 300 (e.g., 101 of FIG. 1) according to an embodiment. FIG. 3A is a side view of the wearable device 300 according to an embodiment. FIG. 3B is a top view of the wearable device 300 according to an embodiment. FIG. 3C is a view illustrating an example in which a wire cable 350 is connected to the wearable device 300 of FIG. 3A.

Referring to FIGS. 3A to 3C, according to an embodiment, a wearable device 300 (e.g., 101 of FIG. 1) may include a housing 310 and a protrusion 320. The housing 310 may be a single one which combines an upper housing 310*a* and a lower housing 310*b* and may have an internal space for receiving various components. For example, sound components (e.g., a speaker or microphone) and electric components (e.g., a battery, power management module, or wireless communication module) may be arranged inside the housing 310. In certain embodiments, the protrusion 320 may be mounted onto housing 310 to form a portion of the housing, while in other embodiments, the protrusion 320 may be integrally formed as part of the housing. Thus "housing" can be understood to include the protrusion.

According to an embodiment, as shown in FIG. 3B, the wearable device 300 may have an asymmetrical shape. In light of ergonomics and securing sound performance, the arrangements between the sound components and electric components inside the housing 310 may be considered first.

According to an embodiment, the wearable device 300 may be a device wearable on the user's body part, e.g., ear or head. Examples of the wearable device 300 may include an in-ear earset (or in-ear headset) or a hearing aid or may include other various products equipped with a speaker or microphone.

The description of the embodiments taken in conjunction with the drawings focuses on a kernel-type in-ear earset which sits in the external auditory meatus which connects from the auricle to the eardrum. However, it should be noted that the disclosure is not limited thereto. According to an embodiment, although not shown, the wearable device 300 may be an open-type earset that sits on the auricle.

Referring to FIGS. 3A to 3C, the wearable device 300 (e.g., 101 of FIG. 1) may be configured to be integrated with or separate from an electronic device (e.g., 102 of FIG. 1). Various types of devices may correspond to the electronic device (e.g., 102 of FIG. 1). The electronic device (e.g., 102 of FIG. 1) may include, e.g., a smartphone, a mobile phone, a navigation device, a game player, a TV, a head-mount unit for vehicles, a laptop computer, a tablet PC, a portable media player (PMP), a portable digital assistant (PDA), a portable communication device, a computer device, a portable multimedia device, a portable medical device, a camera, a wearable device, or various home appliances. According to an embodiment of the disclosure, the electronic device is not limited to the above-listed embodiments.

The wearable device 300 may be wiredly or wirelessly connected with the electronic device (e.g., 102 of FIG. 1). In this case, in relation with the electronic device (e.g., 102 of FIG. 1), the wearable device 300 may serve as an audio output interface (or a sound output device (e.g., 155 of FIG. 1) that outputs sound signals produced from the electronic device (e.g., 102 of FIG. 1) to the outside. Additionally or alternatively, the wearable device 300 disclosed herein may play a role as an audio input interface (or an input device (e.g., 150 of FIG. 1)) to receive audio signals corresponding to the sounds obtained from the outside of the electronic device (e.g., 102 of FIG. 1).

Described below is an example in which the wearable device 300 is provided separately from an electronic device (e.g., 102 of FIG. 1). Given that the electronic device (e.g., 102 of FIG. 1) may be provided separately from the wearable device 300, the electronic device (e.g., 102 of FIG. 1) may also be referred to as an external electronic device (e.g., 102 of FIG. 1). Referring to FIG. 3C, the wearable device 300 may be wiredly connected to the external electronic device (e.g., 102 of FIG. 1). In this case, the wearable device 300 may communicate with the external electronic device via a cable 350. Alternatively, the wearable device 300 may further include an connecting port 340 for connection of the cable 350. According to an embodiment, one end of the cable 350 may be connected to the wearable device 300, and the other end of the cable 350 may be connected to a connection terminal (not shown) formed in the external electronic device. Thus, the wearable device 300 and the external electronic device may be directly connected together.

When the wearable device 300 is wirelessly connected with the external electronic device (e.g., 102 of FIG. 1) (e.g., as shown in FIG. FIG. 3A), the wearable device 300 may communicate with the external electronic device via a network (e.g., a short-range wireless communication network or a remote wireless communication network). The network may include, but is not limited to, a mobile or cellular communication network, a local area network (LAN) (e.g., Bluetooth communication), a wireless local area network (WLAN), a wide area network (WAN), the Internet, or a small area network (SAN).

The wearable device 300 may include a communication module. According to an embodiment, the wearable device 300 may further include at least one of a power management module, a sensor module, a battery, and an antenna module. In the embodiment in which the wearable device 300 wirelessly connects to the external electronic device, a wireless communication module may correspond to the communication module. According to an embodiment, the wearable device 300 may include an audio module (e.g., 170 of FIG. 1) in additional to the above-described components, and the audio module may be integrated in a compact structure inside the housing 310 of the wearable device 300. The audio module (e.g., 170 of FIG. 1) may include, for example, an audio input mixer (e.g., 220 of FIG. 2), an analog-to-digital converter (ADC) (e.g., 230 of FIG. 2), an audio signal processor (e.g., 240 of FIG. 2), a digital-to-analog converter (DAC) (e.g., 250 of FIG. 2), and an audio output mixer (e.g., 260 of FIG. 2). The components of the audio module in the wearable device 300 which have been described above in connection with the embodiments of FIG. 2 are excluded from the description.

According to an embodiment, the wearable device 300 may refrain from communicating with the external electronic device. In this case, the wearable device 300 may be implemented to receive signals corresponding to sounds obtained from the outside and output sound signals to the outside by the own operation (or control) of the components included in the wearable device 300, rather than controlled by the external electronic device.

Figure 4:
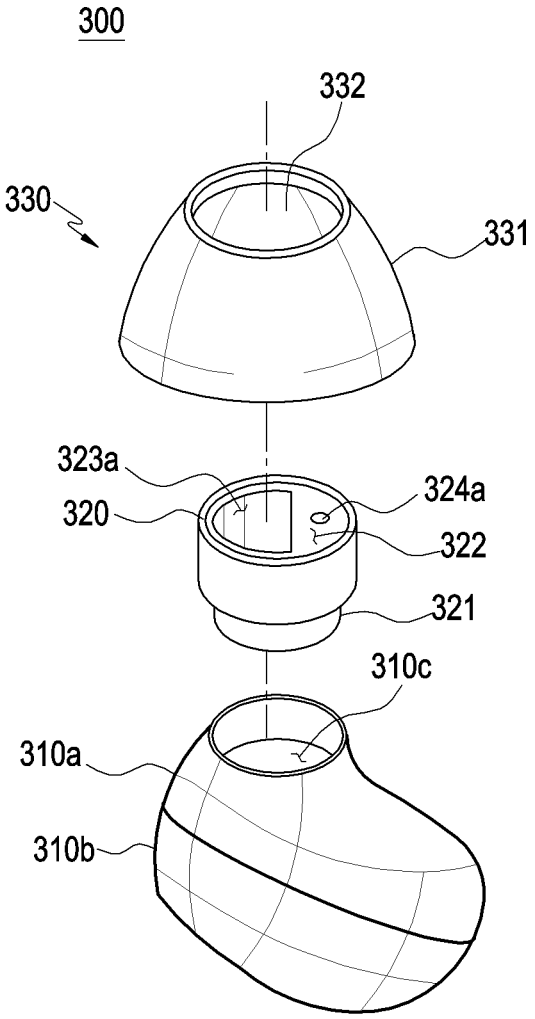
FIG. 4 is an exploded perspective view illustrating a housing of a wearable device and an ear tip mounted in the wearable device according to an embodiment.
Figure 5:
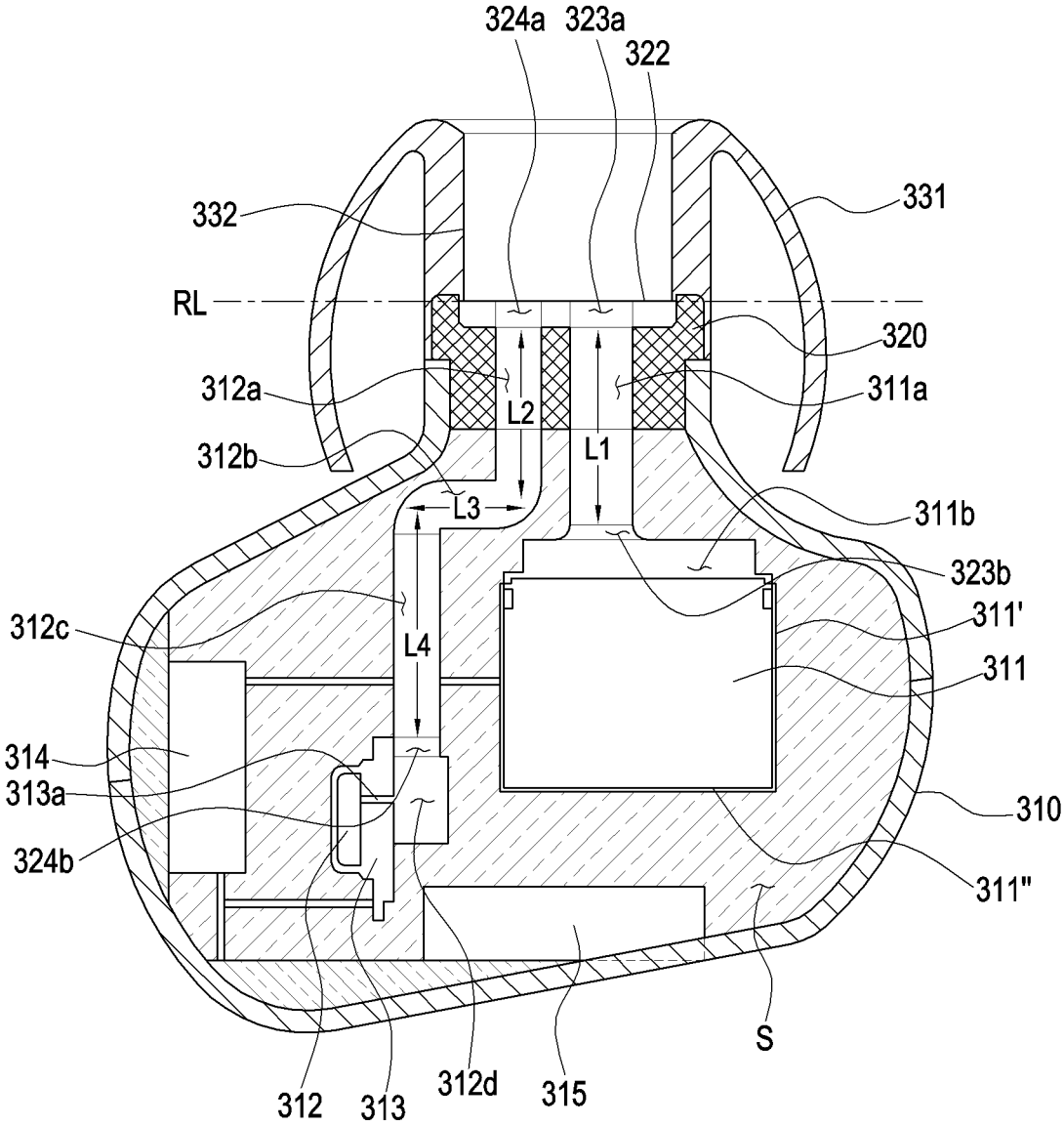
FIG. 5 is a cross-sectional view schematically illustrating a wearable device according to an embodiment.

FIG. 4 is an exploded perspective view illustrating the housing 310 of the wearable device 300 and an eartip 330 equipped in the wearable device 300 according to an embodiment. FIG. 5 is a cross-sectional view schematically illustrating a wearable device 300 according to an embodiment.

Referring to FIG. 4, the housing 310 may include an upper housing 310*a* and a lower housing 310*b*. The housing 310 may include a protrusion 320 insertable into the user's ear. The protrusion 320 may be a portion coupled to project from one side of the housing 310 in one direction. The wearable device 300 may be inserted and seated in the user's body part (e.g., the external auditory meatus or auricle) via the protrusion 320. The eartip 330 may be mounted on the protrusion 320 and the wearable device 300 may be brought in tight contact to the body part via the eartip 330 and may thus rest on the body part in a stable manner.

The eartip 330 may include an outside eartip surface 331 which may contact at least a body part and an inside eartip surface 332 which provides a path along which sounds are radiated and/or collected in the user's body part.

Referring to FIGS. 4 and 5, according to an embodiment, the housing 310 may include a recess 310*c* for allowing a first sound path 311*a* (it may be referred to as "a first cavity" below). and a second sound path 312*a*, 312*b*, and 312*c* (it may be referred to as "a second cavity" below) to communicate with the outside. According to an embodiment, the recess 310*c* may be formed in one side (e.g., the upper housing 310*a*) of the housing 310.

According to an embodiment, the protrusion 320 may be disposed on one side of the housing 310. The protrusion 320 may be formed separately from the housing 310 and be then mounted on the housing 310 to form a part of the housing. According to an embodiment, a lower coupling part 321 of the protrusion 320 provided separately from the housing 310 is inserted and fastened in the recess 310*c* formed in one side of the housing 310, thereby becoming a part of the housing. According to an embodiment, unlike shown in the drawings, the protrusion 320 may be integrally formed with the housing 310. According to an embodiment, the first sound path 311*a* and the second sound path 312*a*, 312*b*, and 312*c* may be defined by the protrusion 320 fitted in the recess 310*c*, and solid material in the housing. In certain embodiments, the first sound path 311*a* may comprise a first cavity 311*a* and the second sound path 312*a*, 312*b*, and 312*c* may comprise a second cavity 312*a*, 312*b*, and 312*c*.

According to an embodiment, the wearable device 300 may further include a speaker (e.g., 311 of FIG. 5) as an audio output interface and may further include a microphone (e.g., 312 of FIG. 5) (e.g., a dynamic microphone, a condenser microphone, or a piezo microphone) as an audio input interface.

Referring to FIG. 5, according to an embodiment, a wearable device 300 comprises a housing 310, a speaker 311, and a microphone 313. The housing has a surface, the surface having an area and another area proximate to the area. In certain embodiments, the area and the another area can be on the surface a protrusion 320 forming part of the housing. In certain embodiments, the area and the another area can be within 5 mm of each other. The speaker 311 is disposed in the housing at a distance from the surface and the microphone 312 is disposed in the housing at a further distance from the surface than the distance of the speaker to the surface. The housing 310 comprises a designated material (e.g. solid material) defining a first sound path 311*a* from the area of the surface to the speaker 311 and a second sound path 312*a*, 312*b*, and 312*c* from the another area of the surface to the microphone 312.

Referring to FIG. 5, according to an embodiment, the wearable device 300 may include a microphone 312 separately from the speaker 311, inside the housing 310. The microphone 312 may include, e.g., a dynamic microphone, a condenser microphone, or a piezo microphone. The wearable device 300 may receive audio signals corresponding to sounds obtained from the outside of the electronic device via the microphone 312.

According to an embodiment, the microphone 312, together with the speaker 311, may be arranged in parallel inside the single housing 310. The outer wall structure of the housing 310 may form a predetermined size of internal space S, and the microphone 312 and the speaker 311 may be placed in the internal space S of the housing 310. According to an embodiment, the speaker 311 may fit into a speaker container 311' for receiving the speaker 311, and the microphone 312 may fit into a microphone container 313 (or on a board) for receiving the microphone 312. According to an embodiment, the microphone 312 may be structured to be seated and bonded in the microphone container 313 (or on a board). Since the microphone 312 is smaller in volume than the speaker 311, the microphone 312 may be easily seated and bonded in the microphone container 313 (or on the board). Given space efficiency, the microphone 312 may be placed in various positions in light of the small volume. According to an embodiment, the position of the microphone 312 may be varied for the purpose of enhancing the sound quality by expanding the band of voice signals.

The housing 310 may include the first sound path 311*a* which is a path for guiding sounds from the speaker 311 and the second sound path 312*a*, 312*b*, and 312*c* which is a path for guiding sounds collected to the microphone 312. According to an embodiment, the rest of the internal space S, except for the spaces for receiving the first sound path 311*a*, the speaker 311, the second sound path 312*a*, 312*b*, and 312*c*, and the microphone 312, may be filled with a designated material (e.g., a resin). According to an embodiment, the internal space S of the housing 310 may further include spaces for receiving other electric components including the controller 314 and the battery 315. Although FIG. 5 illustrates that the controller 314 and the battery 315 are installed on a flat portion formed inside the housing 310, the shape of the inside of the housing 310 and placement of each component are not limited thereto. Although FIG. 5 illustrates that the housing 310, the flat portion formed inside the housing 310, and the spaces S surrounding the electric components are formed of different materials, the disclosure is not limited thereto. The housing 310 may be substantially integrally formed with the rest except for the first sound path 311*a*, speaker 311, second sound path 312*a*, 312*b*, and 312*c*, microphone 312, and electric components inside the housing 310. According to an embodiment, the rest except for the first sound path 311*a* and the second sound path 312*a*, 312*b*, and 312*c* may be formed of a cavity. The components inside the housing 310 may be placed in various arrangements according to embodiments.

The protrusion 320 may include at least two openings 323*a* and 324*a* in one surface (e.g., the top surface 322). Any one of the at least one two openings 323*a* and 324*a* may be a first opening 323*a* for externally discharging (or radiating) sounds output from the speaker (e.g., 311 of FIG. 5), and another may be a third opening 324*a* for collecting sounds obtained from the outside into the microphone (e.g., 312 of FIG. 5).

According to an embodiment, the protrusion 320 may include the first opening 323*a* and the third opening 324*a* respectively communicating with an end of the first sound path 311*a* and an end of the second sound path 312*a*, 312*b*, and 312*c*. A sound generated from the speaker 311 may be output through the first sound path 311*a* and then the first opening 323*a* to the outside, and a portion of the sound output through the first opening 323*a* may be input through the third opening 324*a* and then collected through the second sound path 312*a*, 312*b*, and 312*c* to the microphone 312.

According to an embodiment, the sound collected through the third opening 324*a* is transferred via the microphone 312 to the speaker 311 in the form of an electrical sound signal, and the speaker 311 may amplify the sound signal and output the amplified sound signal through the first opening 323*a* to the outside.

According to an embodiment, the first sound path 311*a* has one end connected with the first opening 323*a* and the other end connected with the second opening 323*b*. The second opening 323*b* may be connected to the speaker 311. One end of the second sound path 312*a*, 312*b*, and 312*c* may be connected to the third opening 324*a*, and the other end may be connected to the fourth opening 324*b*. The fourth opening 324*b* may be connected to the microphone 312.

In the disclosure, there is provided a method for enhancing the sound performance based on geometrical information about the second sound path 312*a*, 312*b*, and 312*c* and the position of the microphone 312 according to the above-described embodiments of the wearable device 300. This is described below in detail.

According to an embodiment of the disclosure, the second sound path 312*a*, 312*b*, and 312*c* may be formed to be longer than the first sound path 311*a*. According to an embodiment, at least a segment (e.g., 312*b*) of the second sound path 312*a*, 312*b*, and 312*c* may be bent in a certain position (e.g., the position adjacent to the speaker 311), and another segment 312*c* may extend through a side of the speaker 311 to the microphone 312.

Figure 11:
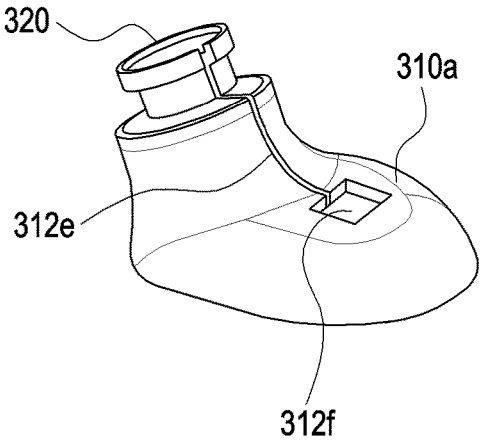
FIG. 11 is a perspective view illustrating a wearable device having a second sound path formed on the surface of the housing according to an embodiment.

According to an embodiment, the first sound path 311*a* extending to the speaker 311 may extend straight without any bend, and the second sound path 312*a*, 312*b*, and 312*c* extending to the microphone 312 may have a bend in at least some segments. The second sound path may include at least two segments. According to an embodiment, the second sound path may include a first segment 312*a* and a second segment 312*b*. Alternatively, the second sound path may include a first segment 312*a*, a second segment 312*b*, and a third segment 312*c*. The second sound path may include more separated segments but no detailed description thereof is given below. Although FIG. 5 illustrates that the second sound path has a bend in the second segment 312*b*, the disclosure is not limited thereto. According to an embodiment, unlike shown in FIG. 5, illustrating that each segment of the second sound path 312*a*, 312*b*, and 312*c* is bent at 90 degrees, the angle between two adjacent segments may be an acute or obtuse angle, or they may be smoothly curved but rather than angled. FIG. 11 illustrates a second sound path 312*e* with a smooth segment. Hereinafter, "curved" shall be understood to also include bent, even where bent in a non-smooth manner.

Referring back to FIGS. 3A to 3C and 5, the housing 310 may be formed in a left/right asymmetrical shape with respect to the protrusion 320. The distance between the top surface 322 of the protrusion 320 and one vertex (e.g., v2 of FIG. 3) on one side thereof may be shorter than the distance between the top surface 322 and another vertex (e.g., v1 of FIG. 3) on the opposite side thereof. According to an embodiment, the left/right asymmetrical shape of the housing 310 may be designed considering the external auditory meatus or auricle in light of ergonomics, or shaped to be seated in the outer ear. According to an embodiment, the left/right asymmetrical shape of the housing 310 may be a shape in which the speaker 311 and the microphone 312 are arranged together in the same space S, with more weight given to calling-receiving/voice recognition performance rather than to ergonomics. For such purposes, the speaker 311 and the microphone 312 may be arranged crossing each other, rather than in parallel with each other. Arranging the speaker 311 and the microphone 312 crossing each other rather than in parallel may include an arrangement of the speaker 311 and the microphone 312 in which they are not positioned in parallel with each other on the same plane (e.g., a plane parallel with a reference line RL or a plane perpendicular to the reference line RL)

According to an embodiment, the housing 310 may be shaped left/right asymmetrically as viewed from above the top of the housing 310 (e.g., refer to FIG. 3B), and the housing 310 may be in a left/right asymmetrical shape as viewed from the side. In other words, the left/right asymmetrical shape of the housing 310 is not applied only plane-like, but is applied in the horizontal and height directions as well (in light of a three-dimensional space). Thus, the second sound path 312*a*, 312*b*, and 312*c* formed to be longer than the first sound path 311*a* may be easily designed.

According to an embodiment, a sound collecting portion 312*d* may be formed at an end of the second sound path 312*a*, 312*b*, and 312*c*, on the side of the microphone 312. The sound collecting portion 312*d* may be a space for collecting sound signals, which are transmitted via the third opening 324*a*, the second sound path 312*a*, 312*b*, and 312*c*, and the fourth opening 324*b* as the air vibrates, before the sound signals are transferred to the microphone.

According to an embodiment, the microphone 312 may be positioned more internally than the speaker 311 than one surface 322 (hereinafter, the 'top surface 322') of the protrusion 320 in the internal space S of the housing 310. In other words, the speaker 311 may be disposed more adjacent to the top surface 322 of the protrusion 320 than the microphone 312 is.

According to an embodiment, the speaker 311 has a sound radiating surface where sounds are emitted and an end 311" formed on the opposite side of the sound radiating surface. The sound radiating surface of the speaker 311 faces in the same direction as the top surface 322, and the end 311" of the speaker 311 may face in the opposite direction to the top surface 322 of the protrusion 320. According to an embodiment, the microphone 312 may be disposed further away from the top surface 322 of the protrusion 320 than the end 311" is. According to an embodiment, the sound collecting hole 313*a* formed in the microphone container 313 (or a board) for receiving the microphone 312 may be formed further away from the top surface 322 of the protrusion 320 than the end 311" is. As the microphone 312 is formed further away from the top surface 322 of the protrusion 320 than the speaker 311 is, the vibration generated when the speaker 311 radiates sound may be prevented from influencing the sound received by the microphone 312. In other words, echo or oscillations of the microphone 312 by the speaker 311 may be prevented.

Figure 6:
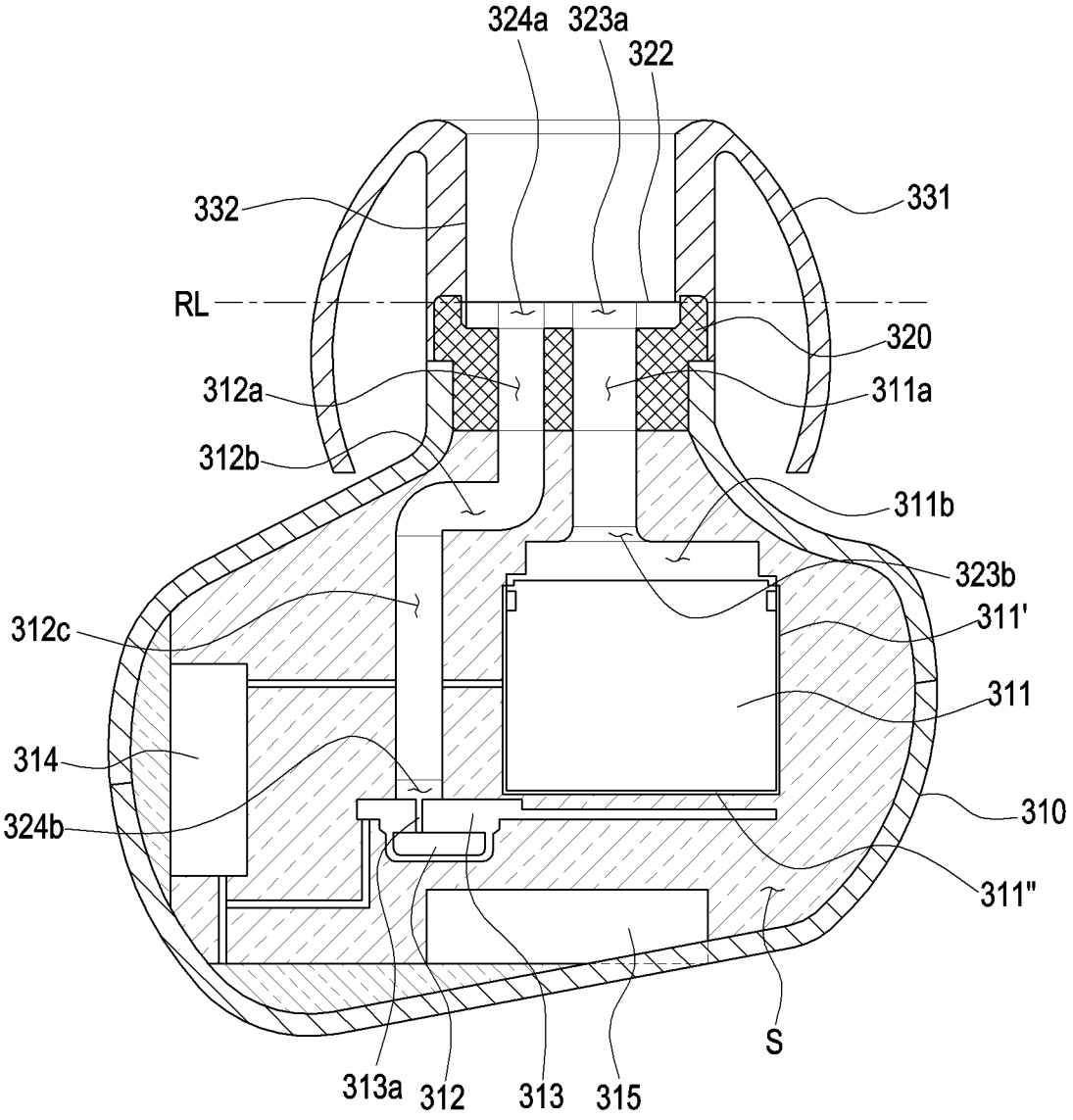
FIG. 6 is a cross-sectional view schematically illustrating a wearable device according to an embodiment different from the embodiment of FIG. 5.

Referring to FIG. 5, the microphone 312 may be placed in the microphone container 313 (or a board) inside the housing 310. For example, the microphone 312 may be bonded and seated in the microphone container 313. According to an embodiment, the microphone 312 may be mounted on the surface of the microphone container 313 or, alternatively, the microphone 312 may be mounted inside the microphone container 313 as shown in FIGS. 5 and 6. The microphone container 313 is a sealed-off structure and has the sound collecting hole 313*a*, thereby enabling sounds received via the fourth opening 324*b* or sound collecting portion 312*d* to be received by the microphone necessarily via the sound collecting hole 313*a*.

According to an embodiment, the rest of the microphone 312 except for the sound collecting hole 313*a* may be surrounded by the microphone container (or board 313).

The microphone container 313 (or board) may be configured to be able to transfer electrical signals to the microphone 312 or function to transfer electrical signals from the microphone 312 to the other components of the wearable device 300. A terminal or connector for signal connection may be disposed on one side of the microphone container 313 (or board) to electrically connect various components. According to an embodiment, the microphone may be a microelectromechanical systems (MEMS) microphone. According to an embodiment, the board 313 may include a printed circuit board (PCB) or a flexible printed circuit board (FPCB).

Figure 7:
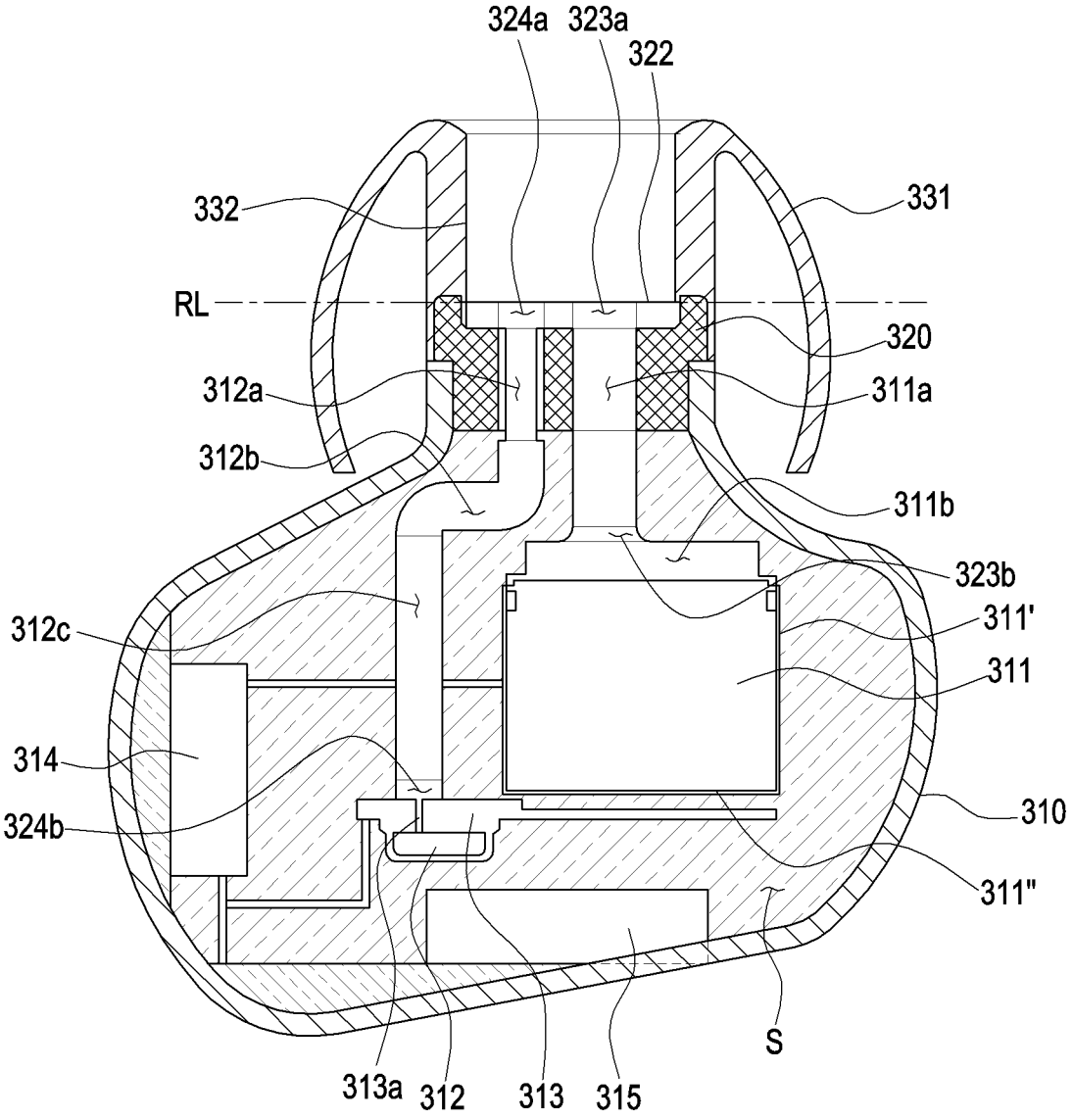
FIG. 7 is a cross-sectional view schematically illustrating a wearable device according to another embodiment different from the embodiment of FIG. 5.
Figure 8:
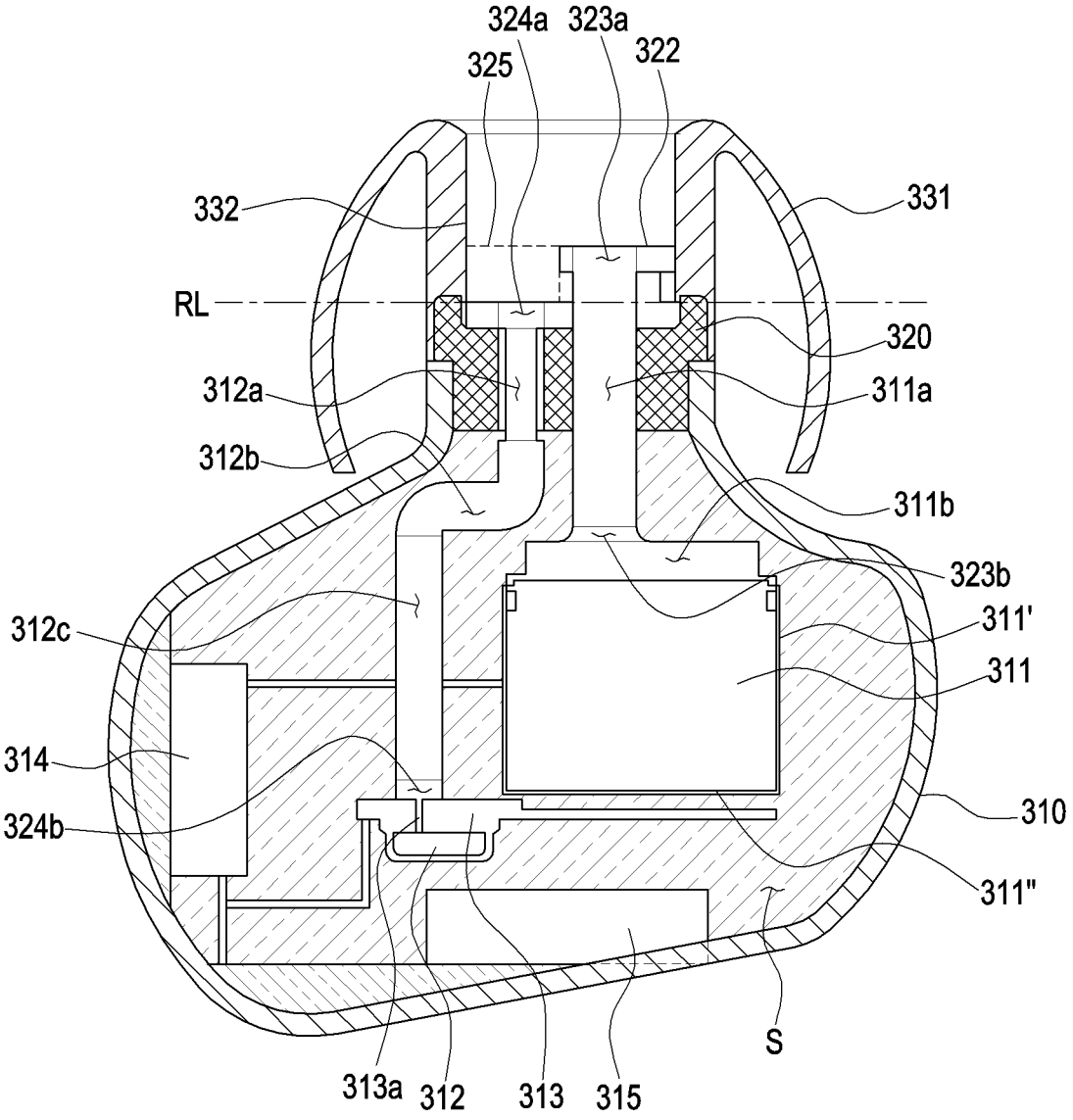
FIG. 8 is a cross-sectional view schematically illustrating a wearable device according to still another embodiment different from the embodiment of FIG. 5.

FIG. 6 is a cross-sectional view schematically illustrating a wearable device 300 according to an embodiment. FIGS. 7 and 8 are cross-sectional views schematically illustrating a wearable device according to other embodiments different from the embodiment of FIG. 5.

According to an embodiment, the microphone container 313 (or board) where the microphone 312 is mounted may be disposed in various positions and forms inside the internal space S of the housing 310. According to an embodiment, as the microphone container 313 (or board) is repositioned, the microphone 312 may be disposed behind the end 311" of the speaker 311 with respect to the top surface 322 of the protrusion 320, and as the sound collecting hole 313*a* of the microphone 312 is rendered to face in the same direction as the top surface 322 of the protrusion 320, the reception sensitivity of the microphone may be increased.

Alternatively, although not shown in the drawings, the microphone container 313 (or board) where the microphone 312 is mounted may be disposed adjacent to the inner wall of the housing 310. For example, the microphone 312 may be installed on a flat portion of the inner wall of the housing 310 which is positioned on the opposite side of the protrusion 320.

According to the above-described embodiments, the position of the microphone 312, the position of the sound collecting hole 313*a*, and the geometrical measurements of the second sound path 312*a*, 312*b*, and 312*c* communicating with the microphone 312 may be designed to have the optimal sound performance, aiming to improve the sound performance.

FIG. 6 is a cross-sectional view schematically illustrating a wearable device 300 according to an embodiment.

Certain embodiments of the disclosure may be described based on Helmholtz resonance.

Helmholtz resonance may refer to the principle for attenuating or amplifying a particular frequency of sound based on the resonance of air in an empty space. Helmholtz resonance is widely known through a Helmholtz resonator with a cavity and a neck as an example application. Here, the Helmholtz resonance frequency may be determined by geometrical information in a space with a certain configuration as shown in Equation 1 below.

$$f_0 = \frac{c}{2\pi}\left(\frac{S}{lV}\right)^{1/2} \quad \text{[Equation 1]}$$

Here, c, S, V, and l, respectively, may denote, c, the sound speed in air (343 m/s or 1125 ft/s), S, the cross section of the neck, V, the volume of the space, l and the length of the neck (or a corrected neck length).

According to an embodiment, the cross section of the first sound path 311*a* and the second sound path 312*a*, 312*b*, and 312*c* may correspond to the cross section S of the neck, and the length of the first sound path 311*a* and the second sound path 312*a*, 312*b*, and 312*c* may correspond to the neck length l. The volume of the space formed by the first sound path 311*a* and the second sound path 312*a*, 312*b*, and 312*c* may correspond to the volume V.

According to an embodiment, an embodiment to which Helmholtz resonance is applied may be disclosed further with reference to FIGS. 5 to 8 which illustrate various example shapes of the segments of the first sound path 311*a* and the second sound path 312*a*, 312*b*, and 312*c*. According to an embodiment, the sound band in which sound collection may be performed by the microphone 312 may be expanded by adjusting the frequency band in which the resonance point is formed by applying certain embodiments related to the first sound path 311*a* and the second sound path 312*a*, 312*b*, and 312*c*.

According to an embodiment, at least some segments of the first sound path 311*a* and the second sound path 312*a*, 312*b*, and 312*c* may be formed to be parallel with each other. At least some segments of the first sound path 311*a* and the second sound path 312*a*, 312*b*, and 312*c* may face in the same direction (e.g., towards the top surface 322 of the protrusion 320). According to an embodiment, the first sound path 311*a* may be formed to be straight, and at least some segments of the second sound path 312*a*, 312*b*, and 312*c* may be formed of curved segments. According to an embodiment, the width (or cross section) of at least a segment of the first sound path 311*a* or second sound path 312*a*, 312*b*, and 312*c* may be smaller than the width (or cross section) of the other segments. For example, FIGS. 5 and 6 illustrate an example in which the second sound path 312*a*, 312*b*, and 312*c* is smaller in width (or cross section) than the first sound path 311*a*. According to an embodiment, FIGS. 7 and 8 illustrate an example in which any one segment (e.g., the first segment 312*a*) of the second sound path 312*a*, 312*b*, and 312*c* is smaller in width than the other segments (e.g., the second segment 312*b* and the third segment 312*c*).

Referring back to FIG. 5, the length, cross section (or width), and volume of the first sound path 311*a* may be denoted with L1, S1, and V1, respectively. When the respective lengths of the first segment 312*a*, the second segment 312*b*, and the third segment 312*c* are L2, L3, and L4, respectively, the length of the second sound path 312*a*, 312*b*, and 312*c* may be the sum L5 of the lengths L2, L3, and L4, i.e., L5=L2+L3+L4. The mean cross section and volume of the second sound path 312*a*, 312*b*, and 312*c* may be denoted with S2 and V2, respectively. The resonance frequency of the sound wave passing through the first sound path 311*a* and the resonance frequency of the sound wave passing through the second sound path 312*a*, 312*b*, and 312*c* may be denoted with f1 and f2, respectively, based on the above geometrical information.

According to an embodiment, the first sound path 311*a* may be designed for the resonance frequency f1 for the first sound path 311*a* to cover an overall, normal human audible frequency band. In contrast, the second sound path 312*a*, 312*b*, and 312*c* may be designed for the resonance frequency f2 for the second sound path 312*a*, 312*b*, and 312*c* to amplify the quantity of obtaining voice signals of a band from 1 kHz to 4 kHz (hereinafter, a 'low band') of the human audible frequency band. Since the second sound path 312*a*, 312*b*, and 312*c* collects sounds of the inside of the external auditory meatus or auricle, voice energy may be concentrated in low band signals of 4 kHz or less but rather than signals of a medium/high band which is larger than 4 kHz. The electronic device disclosed herein may provide a structure for the microphone 312 which is specified to collect such low-band signals.

According to an embodiment, as an example for amplifying the magnitude of, and collecting, sound signals near the low band, the second sound path 312*a*, 312*b*, and 312*c* may be formed to be longer than the first sound path 311*a* as shown in FIGS. 5 and 6. To optimize the resonance frequency f2 for the second sound path 312*a*, 312*b*, and 312*c* in the limited space S, the microphone 312 is disposed behind the speaker 311, and a sufficient length may be secured for the second sound path 312*a*, 312*b*, and 312*c*. If the second sound path is formed to be longer, the resonance frequency f2 of the electronic device may be rendered to be able to cover signals of a much lower frequency band than the prior art, thus enabling sound signals near the low band to be obtained more effectively.

According to an embodiment, the volume of the second sound path 312*a*, 312*b*, and 312*c* may be increased to increase the magnitude of near-low band voice signals. As set forth above, the volume V may be determined by the width W and length L of the path. According to an embodiment, the total volume V2 may be increased by placing the microphone 312 behind the speaker 311 and expanding the second sound path 312*a*, 312*b*, and 312*c*. If the total volume V2 of the second sound path 312*a*, 312*b*, and 312*c* is increased, the resonance frequency f2 of the electronic device may be rendered to be able to cover signals of a much lower frequency band than the prior art, thus enabling sound signals near the low band to be obtained more effectively.

According to an embodiment, the cross section (or width) of at least a segment (e.g., 312*a*) of the second sound path 312*a*, 312*b*, and 312*c* may be reduced to increase the magnitude of near-low band voice signals. The resonance frequency f2 may be reduced by decreasing the cross section of some segment (e.g., 312*a*) of the second sound path 312*a*, 312*b*, and 312*c* and, thus, the resonance frequency f2 of the electronic device may be rendered to be able to cover signals of a much lower frequency band than the prior art, thus enabling sound signals near the low band to be obtained more effectively.

As set forth above, according to an embodiment, there may be provided the optimal design and method for the position of the microphone 312, and the geometrical measurements and shapes of the sound collecting hole 313*a* and the second sound path 312*a*, 312*b*, and 312*c* considering Helmholtz resonance. This leads to an increase in the magnitude of voice signals in the low band where voice signals are concentrated.

Now described are certain embodiments of the sound collecting path 312*e* and the shape of the protrusion 320 with reference to FIGS. 9 to 12.

Figure 9:
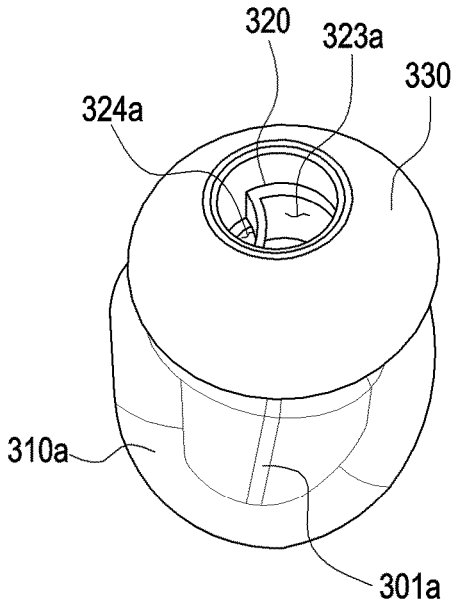
FIG. 9 is a view schematically illustrating the shape of a protrusion according to an embodiment.
Figure 10:
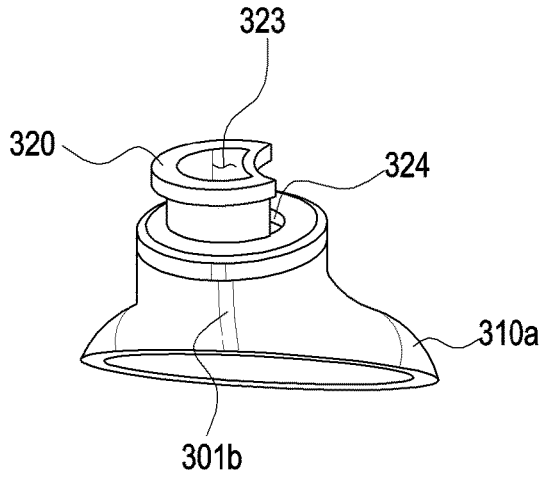
FIG. 10 is a view schematically illustrating the wearable device, with the ear tip removed, in the embodiment of FIG. 9.
Figure 12:
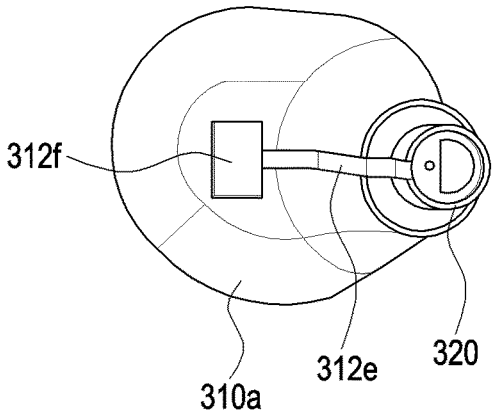
FIG. 12 is a top view illustrating the wearable device of FIG. 11.

FIG. 9 is a view schematically illustrating the shape of a protrusion 320 according to an embodiment. FIG. 10 is a view schematically illustrating the wearable device, with the ear tip 330 removed, in the embodiment of FIG. 9. FIG. 11 is a perspective view illustrating a wearable device 100 having a second sound path 312*e* formed on the surface of the housing according to an embodiment. FIG. 12 is a top view illustrating the wearable device 300 of FIG. 11. In the embodiment of FIGS. 9 and 10, the protrusion 320 may be the protrusion 320 of FIG. 8.

According to an embodiment, the wearable device 300 may further include an eartip 330 which may be disposed to surround at least a portion of the protrusion 320. The eartip 330 may be formed to surround the rest of the protrusion 320 except for the coupling part (e.g., 321 of FIG. 4) which is the portion coupled with the housing (e.g., 310 of FIG. 5).

Referring to FIGS. 9 and 10, according to an embodiment, the first opening 323*a* communicating with the first sound path (e.g., 311*a* of FIG. 5) may externally project from the top surface (e.g., 322 of FIG. 3) of the protrusion 320. According to an embodiment, the third opening 324*a* may be positioned at a different height than the first opening 323*a*, thus forming a step.

According to an embodiment, as the first opening 323*a* projects and is positioned at a different height than the third opening 324*a* to thus form a step, the size of the first opening 323*a* and the third opening 324*a* may be expanded. For example, if the first opening 323*a* and the second opening 324*a* are positioned on the same plane (e.g., the top surface 322 of the protrusion 320), a separate barrier may need between the first opening 323*a* and the third opening 324*a*. As the barrier is provided, the size of the first opening 323*a* and the third opening 324*a* may be reduced. However, according to an embodiment, as the first opening 323*a* projects and is positioned at a different height than the second opening 324*a*, the barrier between the first opening 323*a* and the second opening 324*a* may be replaced by the projecting inner wall of the first opening 323*a*.

According to an embodiment, the eartip 330 may be mounted in the structure in which the first opening 323*a* externally projects from the top surface (e.g., 322 of FIG. 5) of the protrusion 320. If the eartip 330 is mounted on the protrusion 320, part of the third opening 324*a* may be sealed. This may present such an effect as if the length L5 of the second sound path (e.g., 312*a*, 312*b*, and 312*c* of FIG. 5) extends up to the height (a virtual line 325) at which the first opening 323*a* projects as shown in FIG. 8.

According to the above-described embodiments, as the first opening 323*a* and the third opening 324*a* are sealed by the eartip 330, with the first opening 323*a* further projecting to the outside, a more length may be secured for the second sound path (e.g., 312*a*, 312*b*, and 312*c* of FIG. 5), and the size (or area) of the first opening 323*a* and the third opening 324*a* may be expanded.

According to an embodiment, at least some segment (e.g., 312*e*) of the second sound path may be formed on the outer surface of the housing 310. FIGS. 11 and 12 illustrate an example in which the second sound path 312*e* is formed in the upper housing 310*a* of the housing 310. According to an embodiment, not only formed in the upper housing 310*a* of the housing 310, the second sound path 312*e* may extend up to the lower housing (e.g., 310*b* of FIG. 3).

According to an embodiment, as shown in FIGS. 11 and 12, a microphone mounting part 312*f* may be added, for mounting the microphone 312, on some surface of the housing 310 positioned at an end of the second sound path 312*e*.

According to an embodiment, for the housing 310 asymmetrically shaped, the second sound path 312*e* may be formed along a longer edge (e.g., 301*a* of FIG. 3) of the external surface 310*a* of the housing 310.

Although not shown in FIGS. 11 and 12, at least a segment of the second sound path 312*e* formed on the outer surface of the housing 310 may be sealed by various covers or an eartip (e.g., 330 of FIG. 9) not shown in the drawings.

While sound paths are formed inside the housing according to the conventional art, the second sound path may be formed adjacent to the surface of the housing 310 so that a sufficient length may be secured for at least a segment (e.g., 313*e*) of the second sound path 312*e* according to the above-described embodiments. As a mounting structure for the microphone 312 is provided at the outside of the housing 310, the space where the microphone 312 is disposed may easily be processed, thus leading to enhanced mass producibility.

Geometrical varieties of microphones (e.g., 312 of FIG. 5) and second sound paths (e.g., 312*a*, 312*b*, and 312*c* of FIG. 5 or 312*e* of FIG. 11) for enhancing sound performance have been described above in connection with the above embodiments. For example, the length of the second sound path (e.g., 312*a*, 312*b*, and 312*c* of FIG. 5 or 312*e* of FIG. 11) may be designed to form a resonance point of 1 kHz to 4 kHz to maximize voice signals of a low band of an audible frequency band, as obtained via the wearable device 300.

Figure 13:
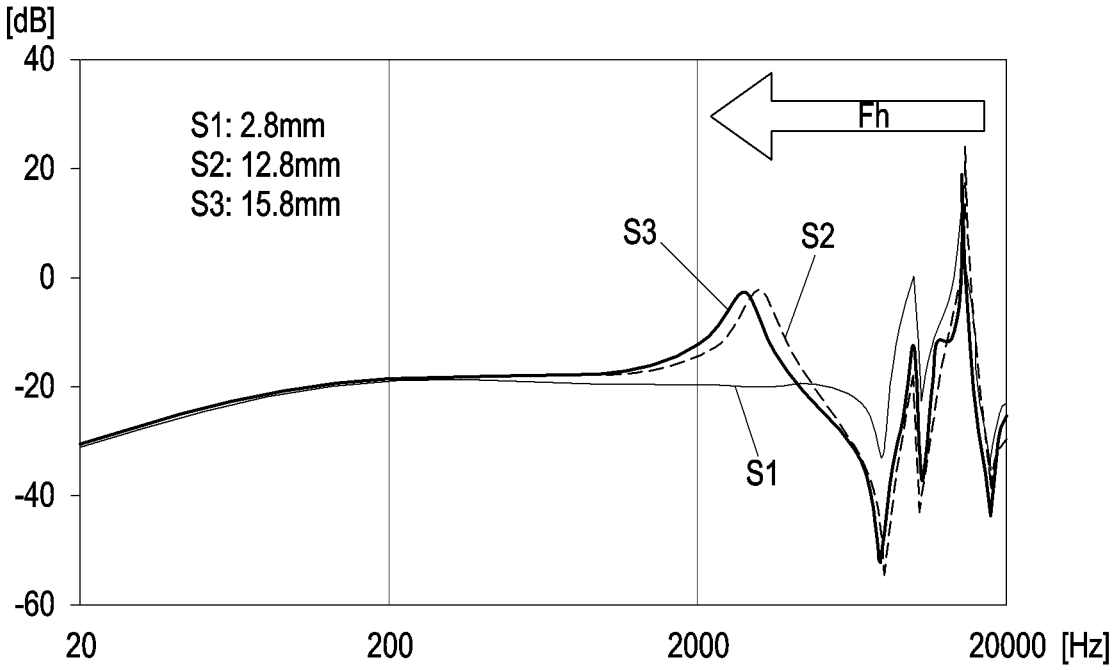
FIG. 13 is a graph illustrating the sound pressure level (SPL) depending on the length of the second sound path according to an embodiment.

FIG. 13 is a graph illustrating the sound pressure level (SPL) depending on the length of the second sound path according to an embodiment.

FIG. 13 illustrates graphs S1 to S3. In FIG. 13, the horizontal axis may denote the frequency, and the vertical axis may denote the output sound in decibels (dB). In FIG. 13, graph S1 represents an example in which the second sound path (e.g., 312*a*, 312*b*, and 312*c* of FIG. 3) has a length of approximately 2.8 mm (approximately 0.11 inches) according to embodiment A. Graph S2 represents an example in which the second sound path (e.g., 312*a*, 312*b*, and 312*c* of FIG. 3) has a length of approximately 12.8 mm (approximately 0.51 inches) according to embodiment B. Graph S3 represents an example in which the second sound path (e.g., 312*a*, 312*b*, and 312*c* of FIG. 3) has a length of approximately 15.8 mm (approximately 0.62 inches) according to embodiment C.

Referring to FIG. 13, it may be identified that as the second sound path (e.g., 312*a*, 312*b*, and 312*c* of FIG. 3) lengthens, the resonance point of the resonance frequency band expands to the low-band side in the audible frequency band, voice energy may form an effective range from 1 kHz to 4 kHz. According to the disclosure, there is provided a wearable device (e.g., 300 of FIG. 3) with the optimized second sound path second sound path (e.g., 312*a*, 312*b*, and 312*c* of FIG. 3), thereby enhancing sound reception performance.

Figure 14:
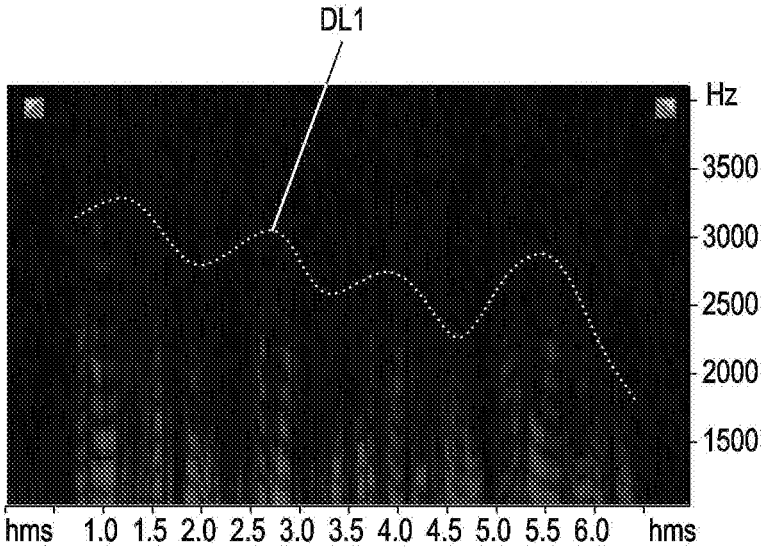
FIG. 14 is a view illustrating the sound performance depending on the length of the second sound path according to an embodiment.
Figure 14:
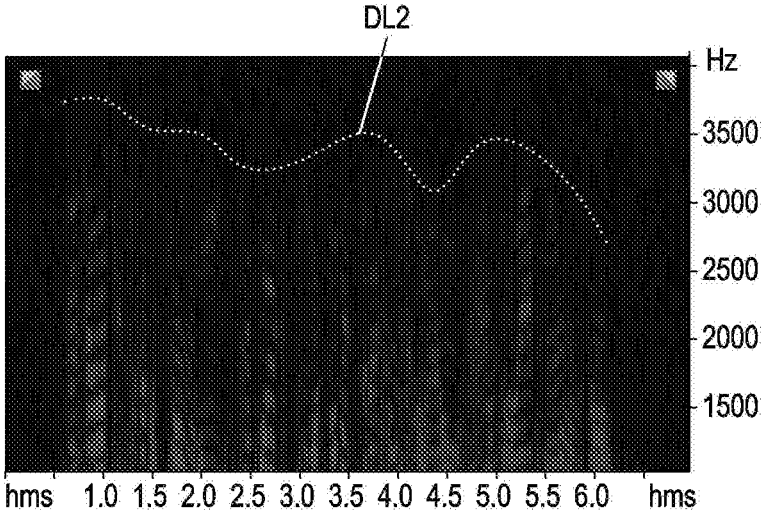

FIG. 14 is a view illustrating the sound performance depending on the length of the second sound path (e.g., 312*a*, 312*b*, and 312*c* of FIG. 3) according to an embodiment. FIG. 14 represents the results of actual data simulation depending on whether the second sound path second sound path (e.g., 312*a*, 312*b*, and 312*c* of FIG. 3) is long or short. For reference, the dot lines DL1, DL2 illustrated in FIG. 14 may briefly represents an aspect in which the frequency range for the received the sound signal changes according to impedance. It shall, however, be understood that foregoing graph is by way of example, and certain embodiments may have different sound performance.

The top graph of FIG. 14 illustrates the frequency range for the received sound signal when the second sound path (e.g., 312*a*, 312*b*, and 312*c* of FIG. 3) is short as a function of the impedance of the first sound path 311*a*, and the bottom graph of FIG. 14 illustrates the frequency range for the received sound signal when the second sound path second sound path (e.g., 312*a*, 312*b*, and 312*c* of FIG. 3) is long as a function of the impedance of the first sound path 311*a*. As shown in FIG. 14, it may be identified from the results of simulation that as the second sound path second sound path (e.g., 312*a*, 312*b*, and 312*c* of FIG. 3) is longer, the frequency range of the sound signal received may increase.

Figure 15:
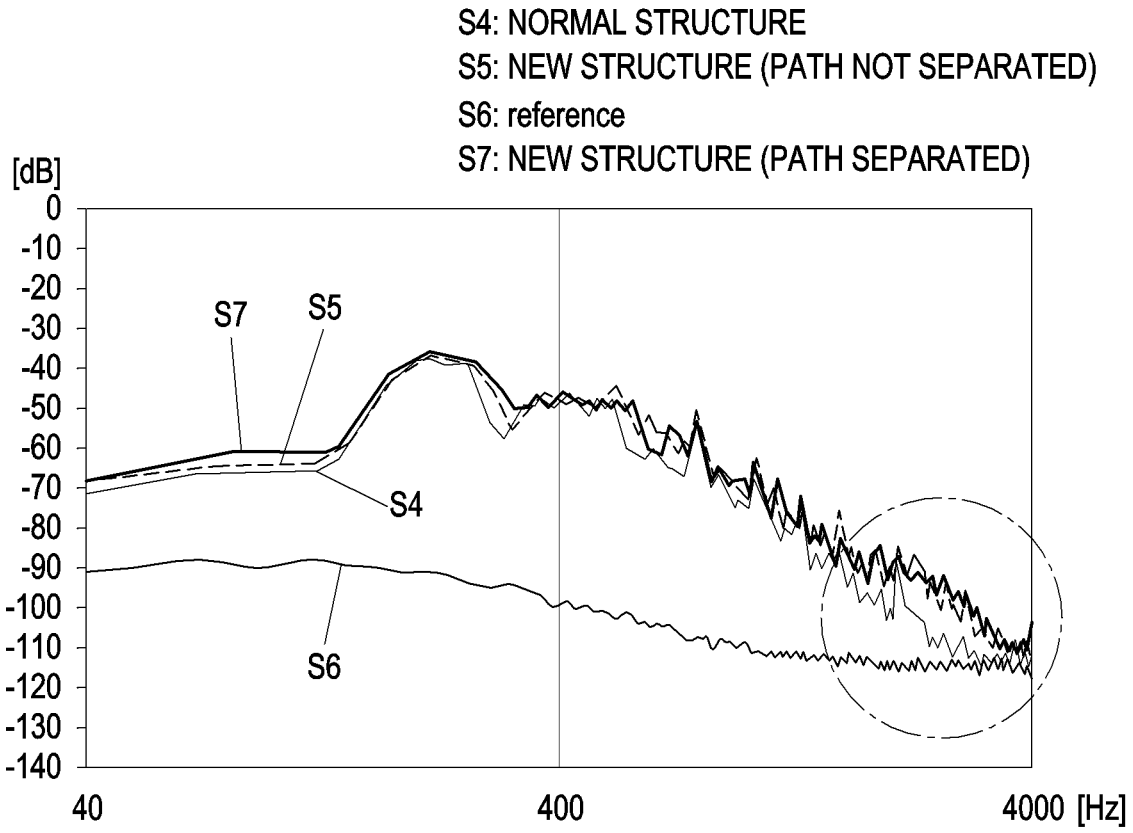
FIG. 15 is a graph illustrating an example in which a band of a sound signal is expanded depending on whether there is a path or not.

FIG. 15 is a graph illustrating an example in which a band of a sound signal is expanded depending on whether there is a path or not.

FIG. 15 illustrates graphs S4 to S7. In FIG. 15, the horizontal axis may denote frequency, and the vertical axis may denote the magnitude of the sound in dB at the frequencies. In FIG. 15, graph S4 represents the band of the voice signal received by a wearable device in the conventional wearable device structure. Graph S5 represents the band of the voice signal received by a wearable device in a new structure which lacks path separation. Graph S6 represents the band of the voice signal received by a wearable device under a no-signal reference condition. Graph S7 represents the band of the voice signal received by a wearable device 300 in a new structure with separated paths as in certain embodiments disclosed herein.

Referring to FIG. 15, although there is no significant difference made between when there is path separation S5 and when there is no path separation S7 over the entire frequency band, it may be identified that the new structure S5 and S7 exhibit an expansion in voice signal band of about 10 dB as compared with the conventional structure S4.

Figure 16A:
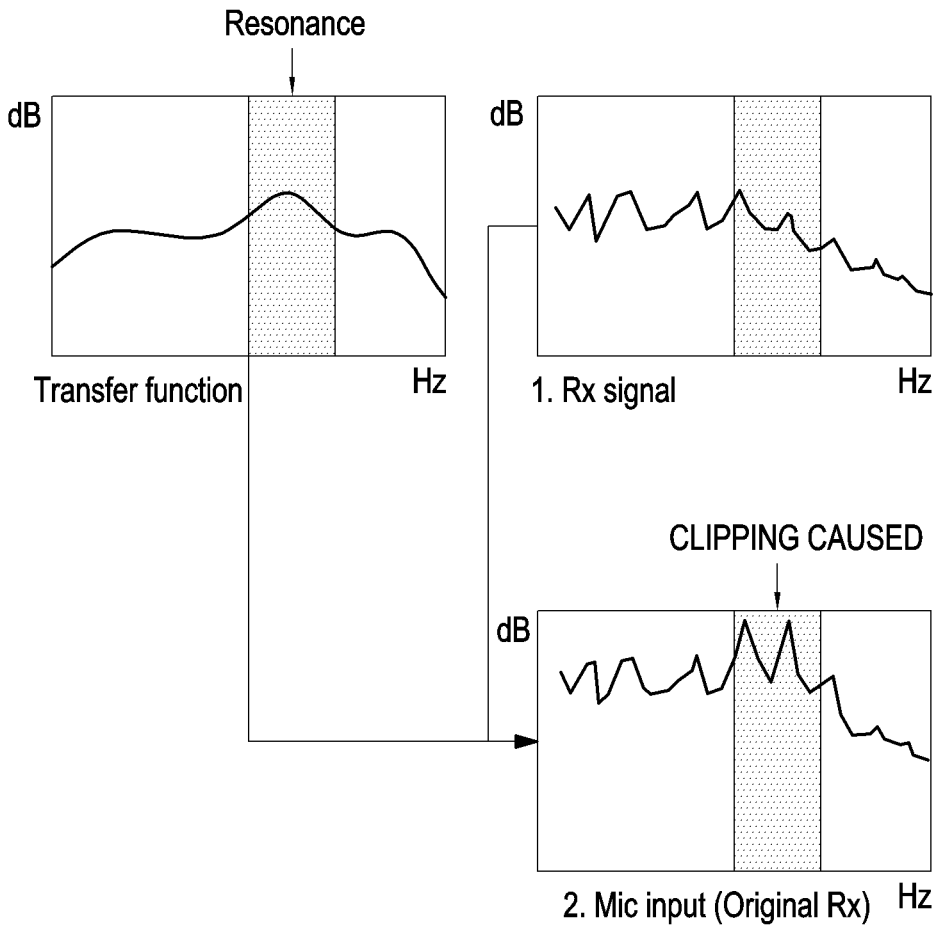
FIGS. 16A and 16B are graphs illustrating an example in which a clipping is caused in an amplified reception signal and an example in which the clipping is removed according to an embodiment.
Figure 16B:
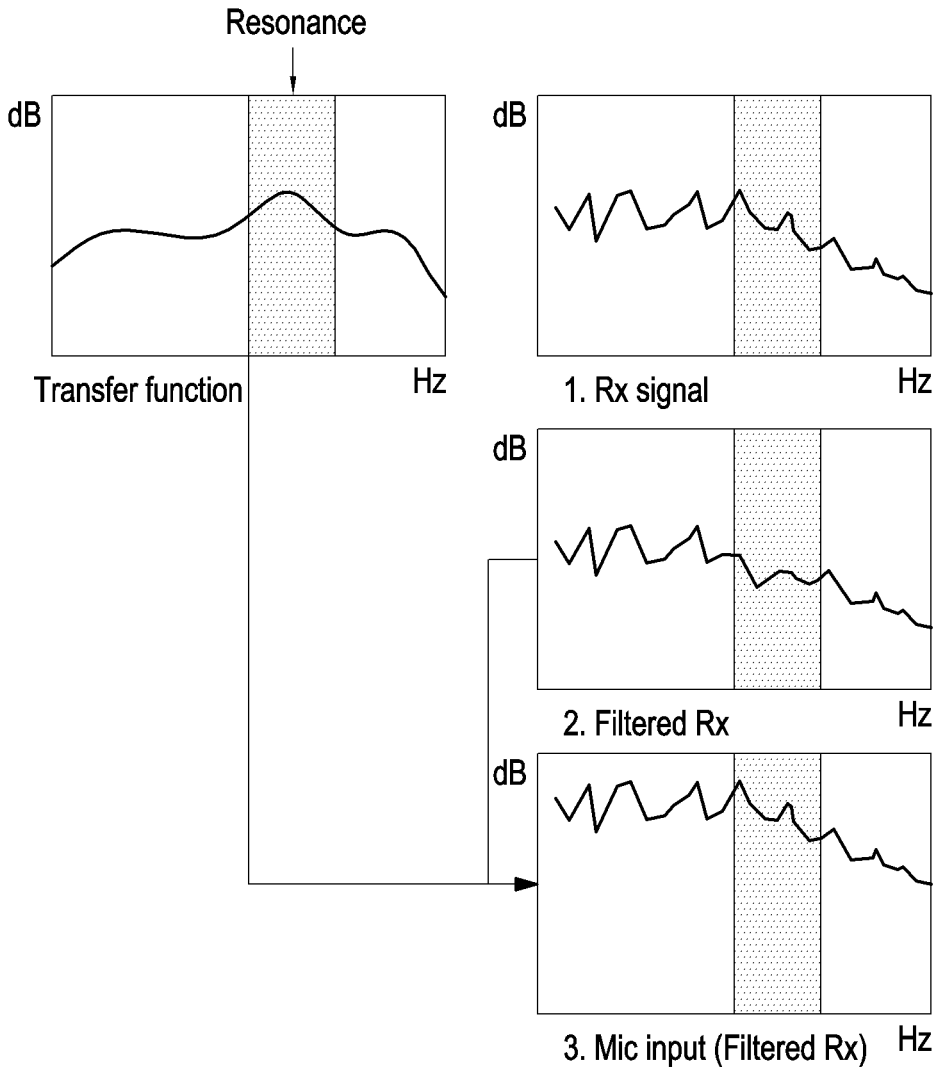

FIGS. 16A and 16B are graphs illustrating an example in which a clipping is caused in an amplified reception signal and an example in which the clipping is removed according to an embodiment.

Referring to FIGS. 16A and 16B, the recess 310*c* (Rx) signal may be amplified and collected to the microphone (e.g., 312 of FIG. 5) in the unique resonance band according to the measurements and shape of the microphone path (the second sound path). At this time, the amplified signal may be clipped while getting through other electronic components (e.g., an analog-to-digital converter (ADC)) inside the housing 310, causing non-linearity in the signal received by the microphone. Thus, pre-processing (e.g., smoothing filtering) may be performed on the reception signal output from the speaker (e.g., 311 of FIG. 5), thereby preventing amplification from occurring in the particular resonance band for the listener while allowing echo cancellation to be performed linearly. Thus, performance may be enhanced. For pre-processing, e.g., a multi-stage filter may be utilized as necessary which smoothes and reverses the magnitude response of the transfer function, band-stop filter, or notch.

The pre-processing may be carried out by a processor included in the electronic device. The processor may execute, for example, software (e.g., a program) to control at least one other component (e.g., a hardware or software component) of the electronic device coupled with the processor, and may perform various data processing or computation. According to one embodiment, as at least part of the data processing or computation, the processor may load a command or data received from another component (e.g., the sensor module or communication module or a sensor module 190) onto a volatile memory, process the command or the data stored in the volatile memory, and store resulting data in a non-volatile memory. According to an embodiment, the processor may include a main processor (e.g., a central processing unit (CPU) or an application processor (AP)), and an auxiliary processor (e.g., a graphics processing unit (GPU), an image signal processor (ISP), a sensor hub processor, or a communication processor (CP)) that is operable independently from, or in conjunction with, the main processor. Additionally or alternatively, the auxiliary processor may be adapted to consume less power than the main processor, or to be specific to a specified function. The auxiliary processor may be implemented as separate from, or as part of the main processor.

According to the above-described embodiments, there may be provided the optimal design for the position of the microphone (e.g., 312 of FIG. 5), the position of the sound collecting hole (e.g., 313*a* of FIG. 5), and the geometrical measurements and shape of the second sound path (e.g., 312*a*, 312*b*, and 312*c* of FIG. 5), thereby increasing the magnitude of voice signals in the low band where voice signals are concentrated.

Further, echo for remote voice signals may be minimized.

The electronic device according to certain embodiments may be one of various types of electronic devices. The electronic devices may include, e.g., a portable communication device (e.g., a smartphone), a computer device, a portable multimedia device, a portable medical device, a camera, a wearable device, or a home appliance. According to an embodiment of the disclosure, the electronic device is not limited to the above-listed embodiments.

It should be appreciated that certain embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to certain embodiments of the disclosure may be included and provided in a computer program product. The computer program products may be traded as commodities between sellers and buyers. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to certain embodiments, each component (e.g., a module or a program) of the above-described components may include a single entity or multiple entities. According to certain embodiments, one or more of the above-described components may be omitted, or one or more other components may be added. Alternatively or additionally, a plurality of components (e.g., modules or programs) may be integrated into a single component. In such a case, according to certain embodiments, the integrated component may still perform one or more functions of each of the plurality of components in the same or similar manner as they are performed by a corresponding one of the plurality of components before the integration. According to certain embodiments, operations performed by the module, the program, or another component may be carried out sequentially, in parallel, repeatedly, or heuristically, or one or more of the operations may be executed in a different order or omitted, or one or more other operations may be added.

According to certain embodiments of the disclosure, a wearable device comprises a speaker, a microphone, and a housing, the housing including a protrusion insertable into a user's ear, a first sound path including a first opening formed through an area of a surface of the protrusion, extending from the first opening in a first length, and including a second opening facing the speaker, and a second sound path including a third opening formed through another area of the surface of the protrusion, extending from the third opening in a second length larger than the first length, and including a fourth opening facing the microphone.

According to certain embodiments, the microphone and the speaker may be arranged in an internal space of the housing. The microphone may be spaced further away from the surface of the protrusion than the speaker is.

According to certain embodiments, the housing may be formed in a left/right asymmetrical shape with respect to the protrusion as viewed from the side.

According to certain embodiments, the first sound path and the second sound path may include at least some segments which are parallel with each other.

According to certain embodiments, the first sound path may be formed of a straight line path, and the second sound path may include at least a curved segment.

According to certain embodiments, a width of at least a segment of the first sound path or the second sound path may be smaller than a width of another segment.

According to certain embodiments, a width of at least a segment of the second sound path may be smaller than a width of the first sound path.

According to certain embodiments, a sound collecting portion may be formed between the second sound path and the microphone.

According to certain embodiments, the area of the protrusion may externally project further than the other area.

According to certain embodiments, the wearable device may further include an ear tip coupled to the protrusion.

According to certain embodiments, a portion of the first opening or the third opening may be sealed by the ear tip.

According to certain embodiments, the first sound path may be formed inside the housing, and at least a portion of the second sound path may be formed along an outer surface of the housing.

According to certain embodiments, the housing may include a first edge extending from an outer surface of the housing to a side with respect to the protrusion and a second edge extending to an opposite side of the side. The first edge may be formed to be longer than the second edge to form an asymmetrical shape. The second sound path may be formed along the first edge.

According to certain embodiments, the wearable device may further include an ear tip sealing at least a portion of the second sound path.

According to certain embodiments, the second sound path may have a length at which a sound signal has a resonance point in a band from 1 kHz to 4 kHz.

According to certain embodiments of the disclosure, a wearable device comprises a speaker, a microphone, and a housing, the housing including a protrusion insertable into a user's ear, a first sound path including a first opening formed through an area of a surface of the protrusion, extending from the first opening in a first length, and including a second opening facing the speaker, and a second sound path including a third opening formed through another area of the surface of the protrusion, extending from the third opening in a second length, and including a fourth opening facing the microphone, wherein the microphone and the speaker are arranged in an internal space of the housing, and wherein the microphone is spaced further away from the surface of the protrusion than the speaker is.

According to certain embodiments, the housing may be formed in a left/right asymmetrical shape with respect to the protrusion as viewed from the side.

According to certain embodiments, the first sound path may be formed inside the housing, and at least a portion of the second sound path may be formed along an outer surface of the housing.

According to certain embodiments of the disclosure, an electronic device comprises a speaker, a microphone, and a housing, the housing including a protrusion insertable into a user's ear, a first sound path including a first opening formed through an area of a surface of the protrusion, extending from the first opening in a first length, and including a second opening facing the speaker, a second sound path including a third opening formed through another area of the surface of the protrusion, extending from the third opening in a second length, and including a fourth opening facing the microphone, and a processor configured to process a sound signal received via the microphone, wherein the microphone and the speaker are arranged in an internal space of the housing, and wherein the microphone is spaced further away from the surface of the protrusion than the speaker is, and wherein the processor is configured to perform a filtering task while processing the sound signal received via the microphone.

The processor may be configured to selectively extract and filter a remote voice signal from the sound signal received via the microphone.

As is apparent from the foregoing description, according to certain embodiments of the disclosure, there is provided the optimal design of measurement and shape of sound paths and the position of the sound collecting hole and the particular space of the microphone, thereby increasing the magnitude of sound signals in a low frequency band where voice signals are concentrated.

According to certain embodiments of the disclosure, echo of remote voice signals may be minimalized.

According to certain embodiments, a wearable device, comprises a housing having a surface, the surface having an area and another area proximate to the surface; a speaker disposed in the housing at a distance from the surface; and a microphone disposed in the housing at a further distance from the surface than the distance of the speaker to the surface; and wherein the housing comprises solid material defining a first cavity from the area of the surface to the speaker and a second cavity from the another area of the surface to the microphone.

According to certain embodiments, the housing comprises a protrusion configured to be received in a human ear, and wherein the area of the surface is an area of the surface of the protrusion and the another area of the surface is another area of the surface of the protrusion.

According to certain embodiments, a wearable device comprises a speaker; a microphone; and a housing, wherein the housing includes a protrusion configured to be insertable into a user's ear, and solid material defining a first cavity from an area of a surface of the protrusion, extending in a first length to face the speaker, and a second cavity formed from another area of the surface of the protrusion, extending a second length, and opening facing the microphone, wherein the microphone and the speaker are arranged in an internal space of the housing, and wherein the microphone is spaced further away from the surface of the protrusion than the speaker is.

According to certain embodiments, an electronic device comprises a speaker; a microphone; and a housing, wherein the housing includes a protrusion configured to be insertable into a user's ear, and solid material defining a first cavity formed through an area of a surface of the protrusion, extending in a first length facing the speaker, a second cavity from another area of the surface of the protrusion, extending in a second length facing the microphone, and a processor configured to process a sound signal received via the microphone, wherein the microphone and the speaker are arranged in an internal space of the housing, and wherein the microphone is spaced further away from the surface of the protrusion than the speaker is, and wherein the processor is configured to perform a filtering task while processing the sound signal received via the microphone.

While the disclosure has been shown and described with reference to exemplary embodiments thereof, it will be apparent to those of ordinary skill in the art that various changes in form and detail may be made thereto without departing from the spirit and scope of the disclosure as defined by the following claims.

Unless otherwise defined, all terms including technical and scientific terms used herein have the same meaning as commonly understood by one of ordinary skill in the art to which the embodiments of the disclosure belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

What is claimed is:

1. A wearable device, comprising:

a speaker;

a microphone; and a housing, wherein the housing includes a protrusion configured to be insertable into a user's ear, a first sound path including a first opening formed through an area of a surface of the protrusion, extending from the first opening in a first length, and including a second opening facing the speaker, and a second sound path including a third opening formed through another area of the surface of the protrusion, extending from the third opening in a second length larger than the first length, and including a fourth opening facing the microphone.

2. The wearable device of claim 1, wherein the microphone and the speaker are configured to be arranged in an internal space of the housing, and wherein the microphone is spaced further away from the surface of the protrusion than the speaker is.

3. The wearable device of claim 1, wherein the housing is formed in a left/right asymmetrical shape with respect to the protrusion as viewed from the side.

4. The wearable device of claim 1, wherein the first sound path and the second sound path include at least some segments which are parallel with each other.

5. The wearable device of claim 1, wherein the first sound path is formed of a straight line path, and the second sound path includes at least a curved segment.

6. The wearable device of claim 1, wherein a width of at least a segment of the first sound path or the second sound path is smaller than a width of another segment.

7. The wearable device of claim 1, wherein a width of at least a segment of the second sound path is smaller than a width of the first sound path.

8. The wearable device of claim 1, wherein a sound collecting portion is formed between the second sound path and the microphone.

9. The wearable device of claim 1, wherein the area of the surface of the protrusion externally projects outward from the housing further than the other area of the surface of the protrusion.

10. The wearable device of claim 1, further comprising an ear tip coupled to the protrusion.

11. The wearable device of claim 10, wherein a portion of the first opening or the third opening is sealed by the ear tip.

12. The wearable device of claim 1, wherein the first sound path is formed inside the housing, and at least a portion of the second sound path is formed along an outer surface of the housing.

13. The wearable device of claim 10, wherein the housing includes a first edge extending from an outer surface of the housing to a side with respect to the protrusion and a second edge extending to an opposite side of the side, wherein the first edge is formed to be longer than the second edge to form an asymmetrical shape, and wherein the second sound path is formed along the first edge.

14. The wearable device of claim 12, further comprising an ear tip configured to seal the at least portion of the second sound path.

15. The wearable device of claim 1, wherein the second sound path has a length at which a sound signal has a resonance point in a bandwidth from 1 kHz to 4 kHz.

16. The wearable device of claim 1, wherein the wearable device includes no other microphones than the microphone.

17. The wearable device of claim 1, wherein the first sound path is unbranched and terminates at the speaker.

18. A wearable device, comprising:

a speaker;

a microphone; and a housing, wherein the housing includes a protrusion configured to be insertable into a user's ear, a first sound path including a first opening formed through an area of a surface of the protrusion, extending from the first opening in a first length, and including a second opening facing the speaker, and a second sound path including a third opening formed through another area of the surface of the protrusion, extending from the third opening in a second length, and including a fourth opening facing the microphone, wherein the microphone and the speaker are arranged in an internal space of the housing, and wherein the microphone is spaced further away from the surface of the protrusion than the speaker is.

19. The wearable device of claim 18, wherein the housing is formed in a left/right asymmetrical shape with respect to the protrusion as viewed from the side.

20. The wearable device of claim 18, wherein the first sound path is formed inside the housing, and at least a portion of the second sound path is formed along an outer surface of the housing.

21. An electronic device, comprising:

a speaker;

a microphone; and a housing, wherein the housing includes a protrusion configured to be insertable into a user's ear, a first sound path including a first opening formed through an area of a surface of the protrusion, extending from the first opening in a first length, and including a second opening facing the speaker, a second sound path including a third opening formed through another area of the surface of the protrusion, extending from the third opening in a second length, and including a fourth opening facing the microphone, and a processor configured to process a sound signal received via the microphone, wherein the microphone and the speaker are arranged in an internal space of the housing, and wherein the microphone is spaced further away from the surface of the protrusion than the speaker is, and wherein the processor is configured to perform a filtering task while processing the sound signal received via the microphone.

22. The electronic device of claim 21, wherein the processor is configured to selectively extract and filter a remote voice signal from the sound signal received via the microphone.

* * * * *